US008582798B2

(12) United States Patent
Staley et al.

(10) Patent No.: US 8,582,798 B2
(45) Date of Patent: Nov. 12, 2013

(54) SPEAKER MOUNTING SYSTEM

(75) Inventors: David Staley, Park City, UT (US); Jonathan Neil Hart, Salt Lake City, UT (US); Devon Ross Sullivan, Asheville, NC (US)

(73) Assignee: MS Electronics, Overland Park, KS (US)

( * ) Notice: Subject to any disclaimer, the term of this patent is extended or adjusted under 35 U.S.C. 154(b) by 9 days.

(21) Appl. No.: 13/368,927

(22) Filed: Feb. 8, 2012

(65) Prior Publication Data

US 2013/0202147 A1 Aug. 8, 2013

(51) Int. Cl.
*H04R 1/02* (2006.01)

(52) U.S. Cl.
USPC ..... 381/387; 381/390; 381/395; 403/359.1; 403/359.4; 403/359.5

(58) Field of Classification Search
USPC ..... 381/361–363, 386, 387, 390, 395; 403/53, 328, 359.1–359.6, 361, 364; 248/447
See application file for complete search history.

(56) References Cited

U.S. PATENT DOCUMENTS 4,582,445 A * 4/1986 Warshawsky ..... 403/97
4,917,343 A * 4/1990 Wainscott ..... 248/447.2
5,547,158 A * 8/1996 Uchimoto et al. ..... 248/396
6,798,892 B2 * 9/2004 Parnell ..... 381/386
7,455,271 B2 * 11/2008 Pincek et al. ..... 248/288.31
8,206,055 B2 * 6/2012 Schafer et al. ..... 403/359.5
2003/0174855 A1 * 9/2003 Hawkins et al. ..... 381/386
2004/0202346 A1 * 10/2004 Park et al. ..... 381/386
2005/0100187 A1 * 5/2005 Yang ..... 381/386
2010/0072328 A1 * 3/2010 Burnham et al. ..... 248/49

* cited by examiner

*Primary Examiner* — Curtis Kuntz
*Assistant Examiner* — Joshua Kaufman
(74) *Attorney, Agent, or Firm* — Hovey Williams LLP

(57) ABSTRACT

A speaker mounting system comprising a speaker housing configured to house a speaker, a wall mount configured to be mechanically fastened to a wall, and one or more adjustment pieces actuatably connecting the speaker housing to the wall mount. The adjustment pieces may comprise a first adjustment piece fixed to the wall mount and a second adjustment piece slidably and rotatably attached to the first adjustment piece and pivotally attached to the speaker housing. The second adjustment piece may be configured to laterally slide toward and away from the wall mount and to rotate about a first axis and the speaker housing may be configured to rotate or pivot relative to the second adjustment piece about a second axis perpendicular to the first axis. The speaker mounting system may also comprise a biasing member and locking mechanism for selectively allowing and preventing rotation about the first and second axes.

13 Claims, 17 Drawing Sheets

SPEAKER MOUNTING SYSTEM

BACKGROUND

1. Field

The present invention relates to adjustable speaker mounting systems.

2. Related Art

Various types of speakers are used in both home audio and commercial environments for both indoor and outdoor projection of sound. There are various acoustic and space-related variables to consider in determining where to mount audio speakers. For example, the location and mounting angle of the speaker may depend on the type of speaker, the size of a room, the shape of the room, the placement, type, and quantity of other speakers in the audio system, and/or the aesthetics of the room. The placement and mounting angle of the speaker can affect where the sound may be heard and how the sound may bounce off of various structures, such as walls. The placement and mounting angle of the speakers may be particularly important in a surround sound system in which multiple speakers are used to cooperatively create a 360-degree audio experience for a listener located at a particular location relative to the speakers.

Once a traditional speaker is mounted to a wall or ceiling, repositioning the speaker is difficult and generally requires various tools. Additionally, mounting a speaker at various angles relative to a vertical or horizontal surface is difficult and may require custom mounting techniques by a skilled craftsman. If any variables regarding the speakers or the room are changed, the speakers may need to be remounted at new angles to compensate for the acoustic changes. This is time-consuming and impractical using standard speaker mounts. While some commercially-available mounts are adjustable, they suffer from various limitations. For example, known ball and socket mounts are difficult to use and are not suitable for supporting heavy speakers.

Accordingly, there is a need for a speaker mounting system that does not suffer from the above limitations.

SUMMARY

Embodiments of the present invention provide a speaker mounting system configured for adjustably mounting an audio speaker to another surface. Specifically, the speaker mounting system may be pivotable and/or rotatable in a plurality of combinations to allow angular adjustment of the speaker along an x-axis, y-axis, and z-axis. In some embodiments of the invention, the speaker mounting system may comprise a speaker housing configured to house or attach to the speaker, a wall mount configured to be mechanically fastened to a wall, and one or more adjustment pieces actuatably connecting the speaker housing to the wall mount. The speaker housing may be selectively and independently rotatable about a first axis perpendicular to the wall mount and selectively and independently rotatable or pivotable about a second axis that is parallel to the wall mount.

In other embodiments of the invention, the speaker mounting system may comprise a speaker housing configured to house or attach to a speaker, a wall mount configured to be mechanically fastened to a wall, a first adjustment piece fixed to the wall mount, and a second adjustment piece slidably and rotatably attached to the first adjustment piece and pivotally attached to the speaker housing. Specifically, the second adjustment piece may be configured to slide and rotate about a center axis of the first adjustment piece and may be configured to rotate relative to the second adjustment piece about an axis perpendicular to the center axis of the first adjustment piece.

In yet another embodiment of the invention, the speaker mounting system may comprise a speaker, a speaker housing configured to house the speaker, a wall mount configured to be mechanically fastened to a wall, a hollow first adjustment piece fixed to the wall mount, and a second adjustment piece having a solid portion and a hollow portion. The solid portion of the second adjustment piece may be slidably and rotatably attached to and positioned within the first adjustment piece and the hollow portion being pivotally attached to the speaker housing. Specifically, the second adjustment piece may be configured to slide and rotate about a center axis of the first adjustment piece and configured to rotate relative to the second adjustment piece about an axis perpendicular to the center axis of the first adjustment piece. Furthermore, the second adjustment piece may comprise one or more interlocking features protruding therefrom, while the first adjustment piece may comprise one or more interlocking features protruding therein and configured to interdigitate with the interlocking features of the second adjustment piece.

The speaker mounting system may further comprise a biasing member positioned and biased to urge the interlocking features of the first and second adjustment pieces to interdigitate, locking rotation of the first adjustment piece relative to the second adjustment piece. Thus, the second adjustment piece is rotatable relative to the first adjustment piece only when the second adjustment piece is pulled or pushed away from or toward the first adjustment piece in an axial direction along the center axis of the first adjustment piece to disengage the interlocking features of the first and second adjustment pieces. Finally, the speaker mounting system may comprise a locking mechanism extending within the hollow portion of the second adjustment piece and configured to selectively prevent and allow rotation of the speaker housing relative to the second adjustment piece.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the preferred embodiments and the accompanying drawing figures.

DESCRIPTION OF DRAWING FIGURES

Embodiments of the present invention are described in detail below with reference to the attached drawing figures, wherein.

Figure 1:
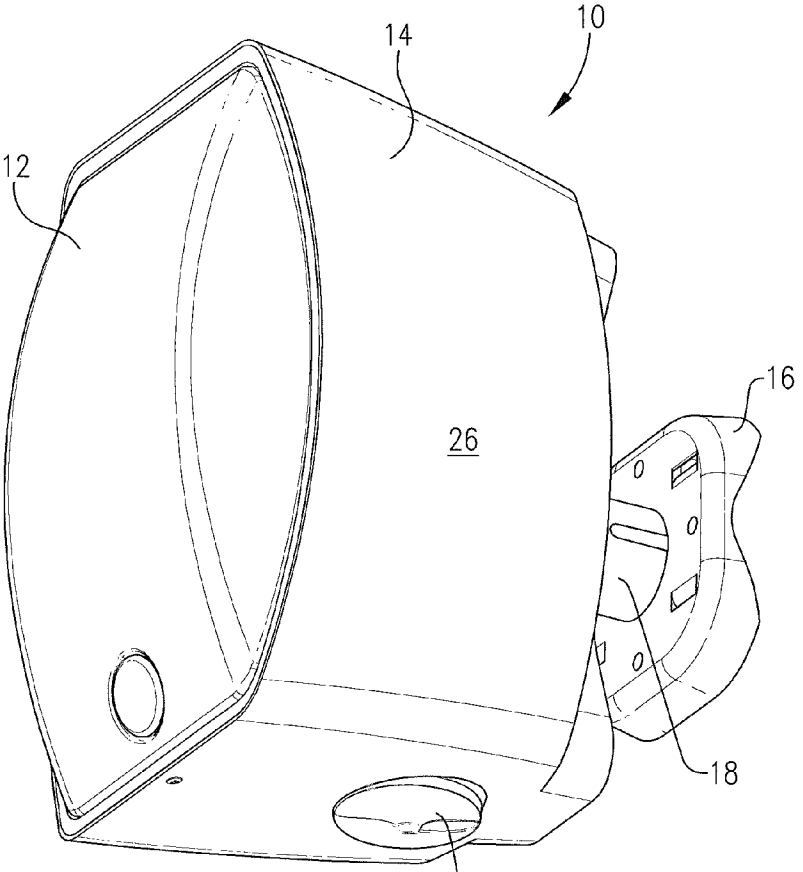
FIG. 1 is a perspective view of a speaker mounting system constructed in accordance with an embodiment of the present invention and including a speaker housing and a speaker.
Figure 14A:
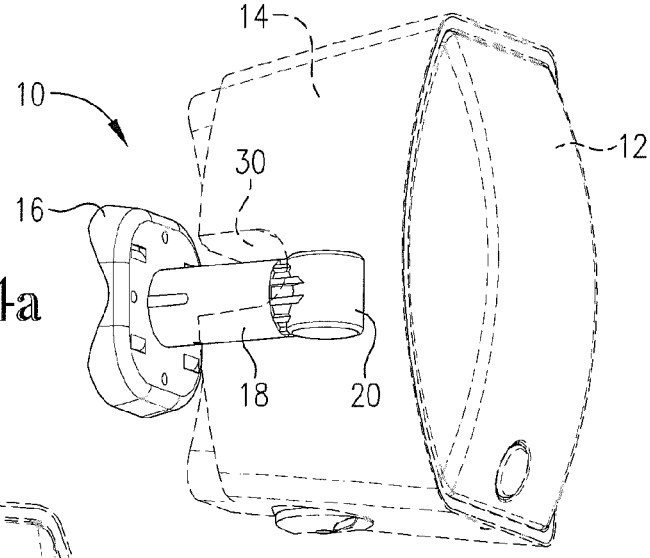
Figure 14B:
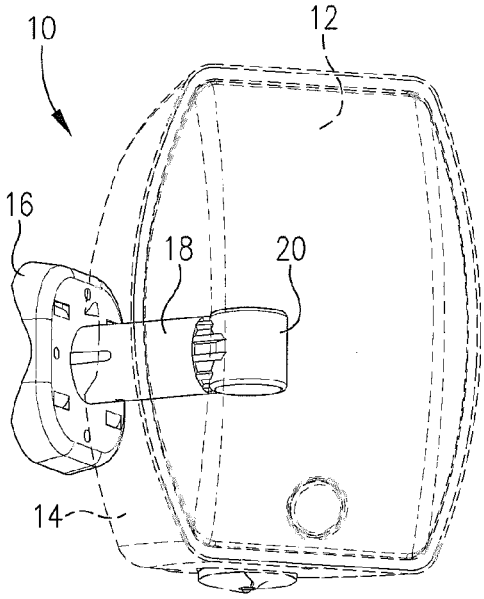
Figure 14C:
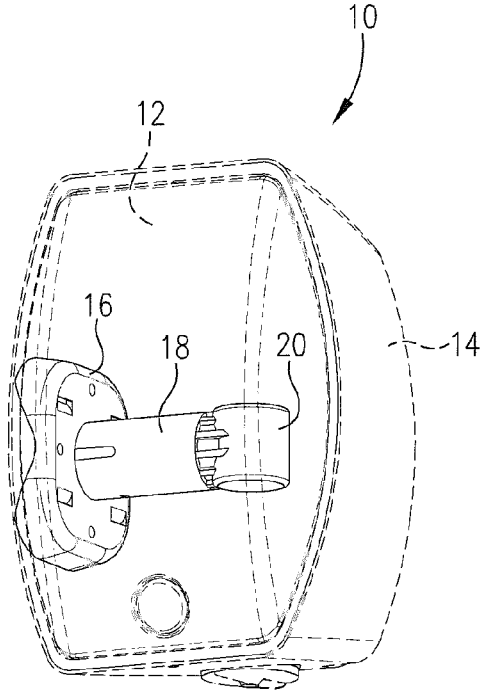
Figure 15A:
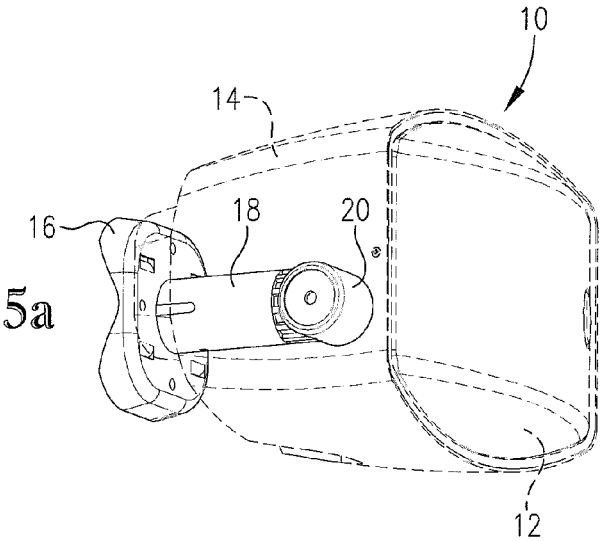
Figure 15B:
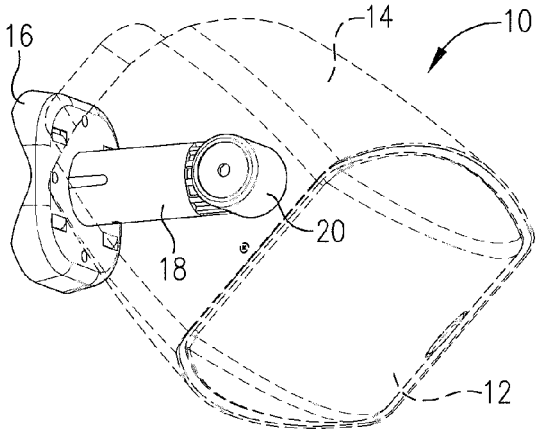
Figure 15C:
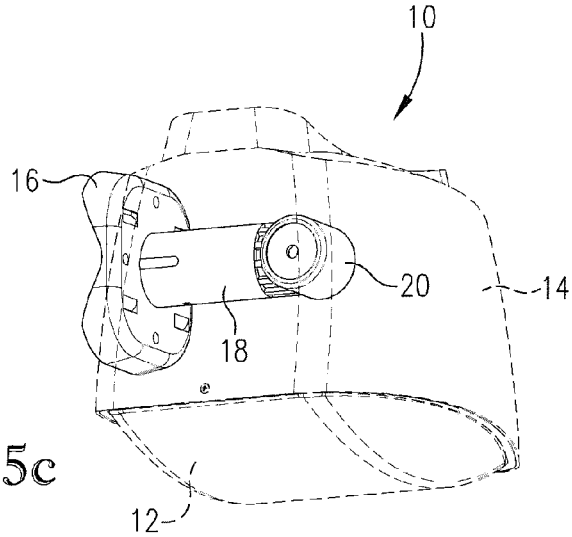
Figure 16A:
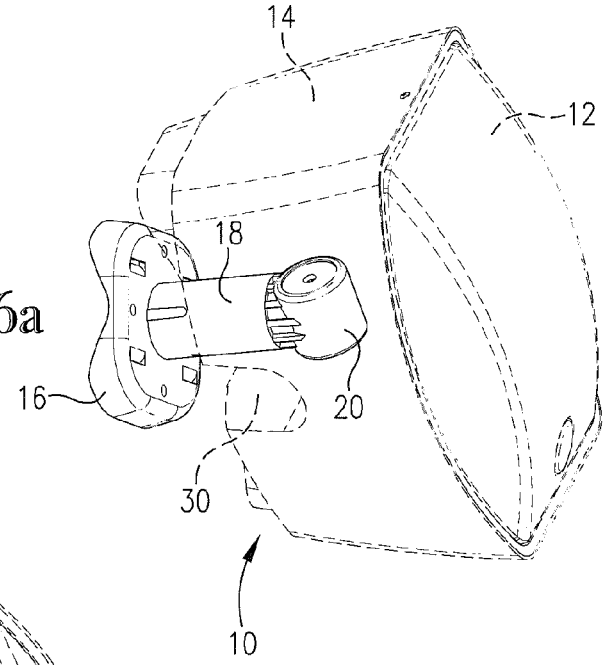
Figure 16B:
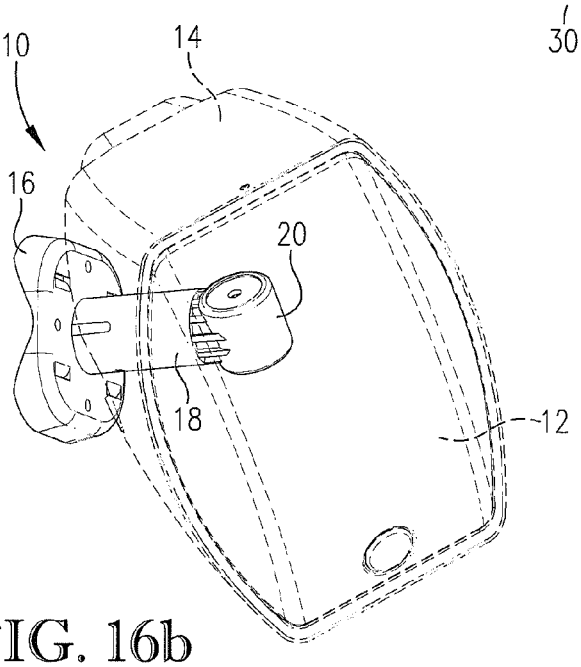
Figure 16C:
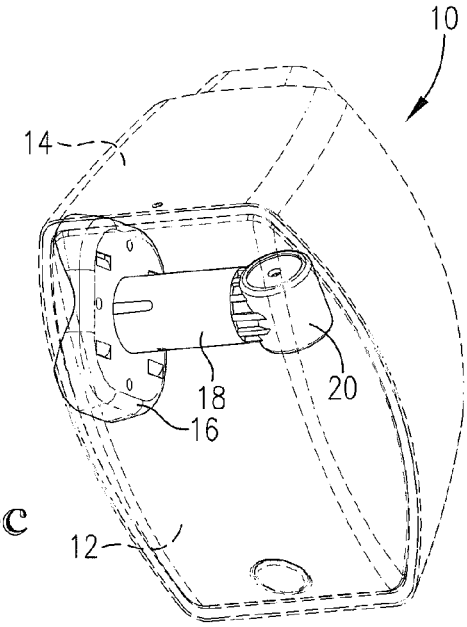
Figure 17:
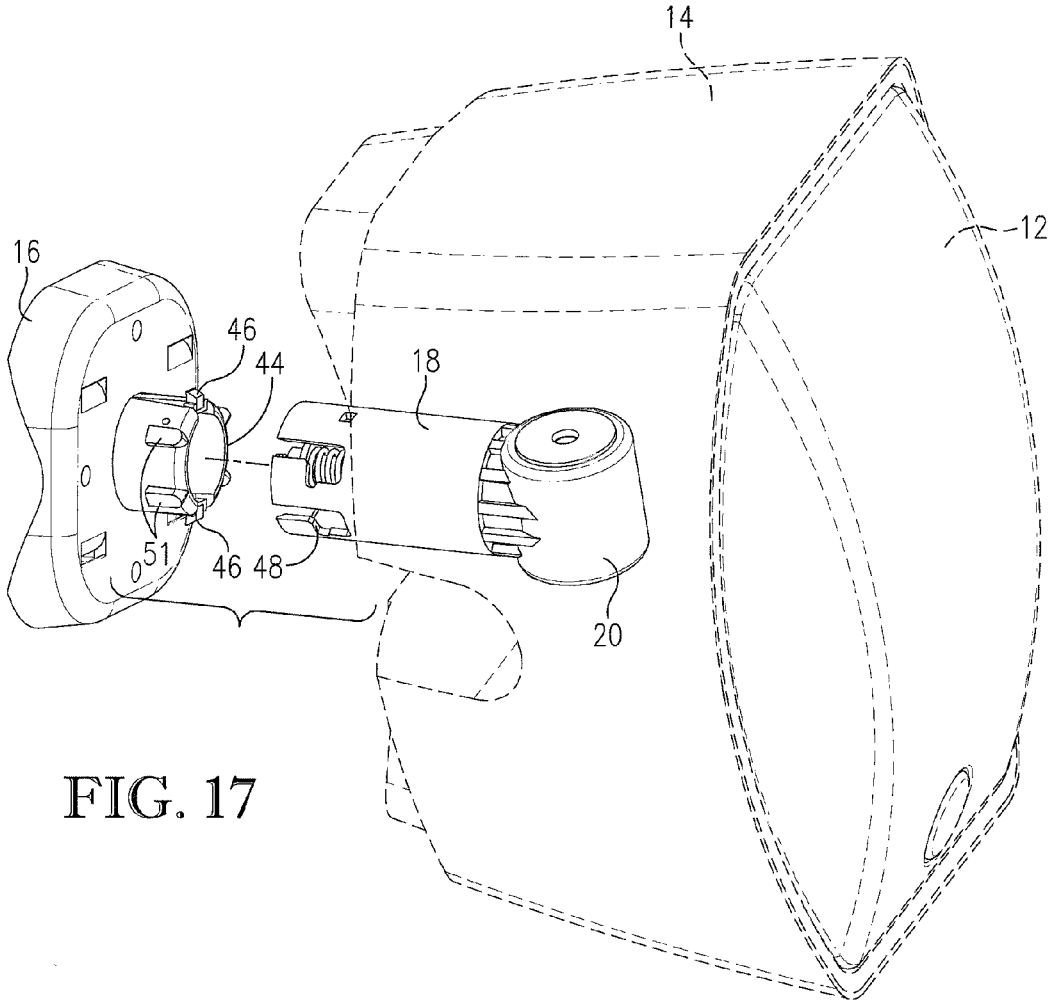
Figure 18:
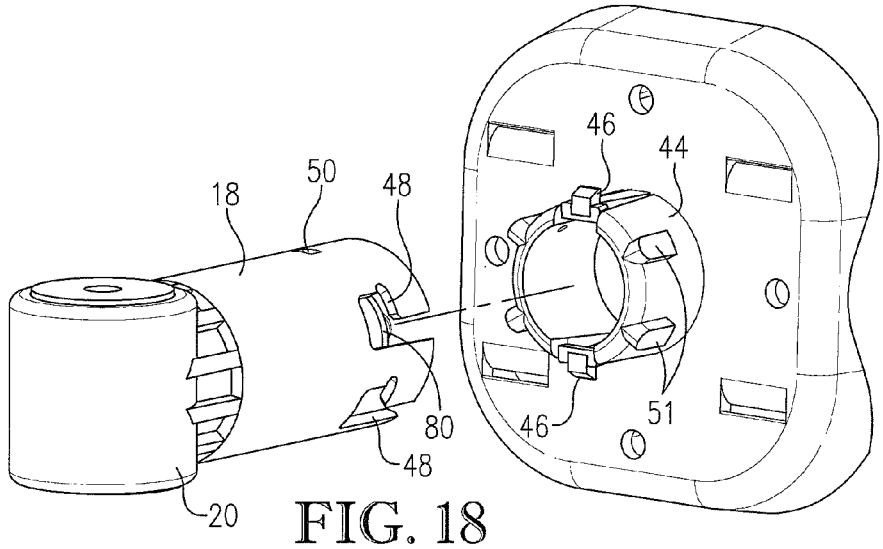
Figure 19:
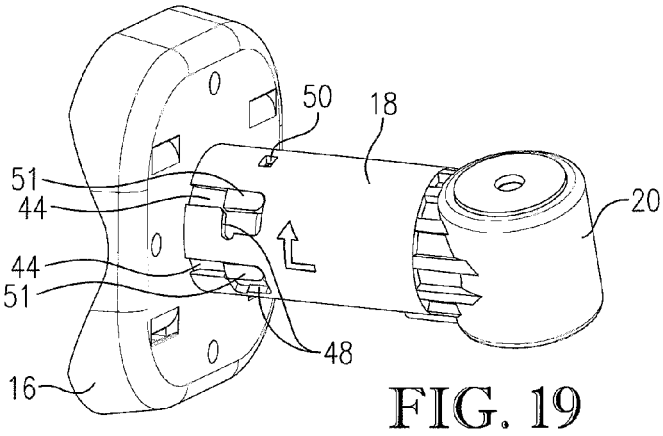
Figure 20:
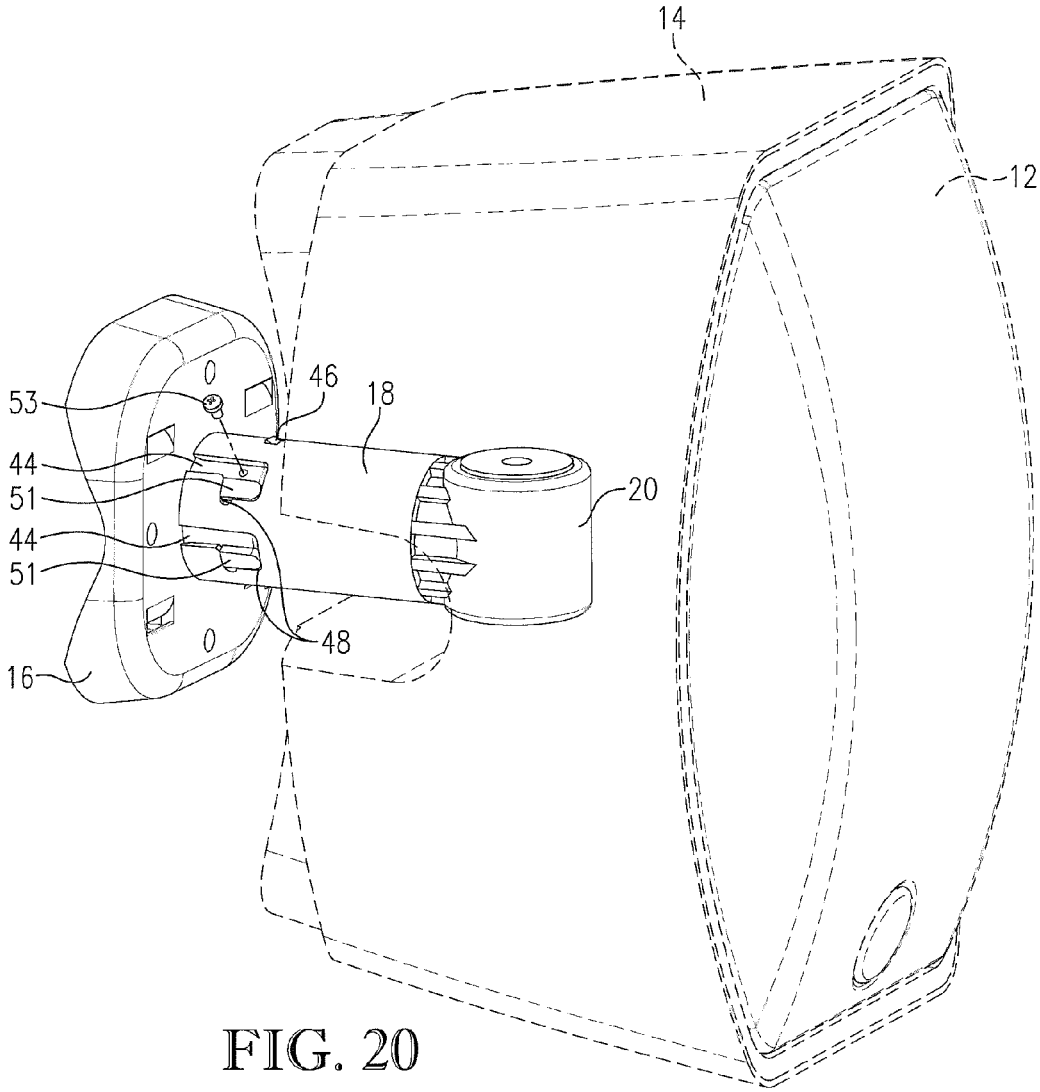

FIG. 14*a* is a perspective view of the speaker mounting system of FIG. 1, with the speaker housing in a first orientation;

FIG. 14*b* is a perspective view of the speaker mounting system of FIG. 14*a*, with the speaker housing in a second orientation rotated approximately 45-degrees about the locking shaft relative to its first orientation;

FIG. 14*c* is a perspective view of the speaker mounting system of FIG. 14*b*, with the speaker housing in a third orientation rotated approximately 45-degrees about the locking shaft relative to its second orientation;

FIG. 15*a* is a perspective view of the speaker mounting system of FIG. 14*a*, with the speaker housing in a fourth orientation rotated approximately 90-degrees about the first adjustment piece relative to its first orientation;

FIG. 15*b* is a perspective view of the speaker mounting system of FIG. 15*a*, with the speaker housing in a fifth orientation rotated approximately 45-degrees about the locking shaft relative to its fourth orientation;

FIG. 15*c* is a perspective view of the speaker mounting system of FIG. 15*b*, with the speaker housing in a sixth orientation rotated approximately 45-degrees about the locking shaft relative to its fifth orientation;

FIG. 16*a* is a perspective view of the speaker mounting system of FIG. 14*a*, with the speaker housing in a seventh orientation rotated approximately 45-degrees about the first adjustment piece relative to its first orientation;

FIG. 16*b* is a perspective view of the speaker mounting system of FIG. 16*a*, with the speaker housing in a eighth orientation rotated approximately 45-degrees about the locking shaft relative to its seventh orientation;

FIG. 16*c* is a perspective view of the speaker mounting system of FIG. 16*b*, with the speaker housing in a ninth orientation rotated approximately 45-degrees about the locking shaft relative to its eighth orientation;

FIG. 17 is an exploded perspective view of an alternative embodiment of the speaker mounting system, including additional locking features for securing the first adjustment piece to the wall mount;

FIG. 18 is an exploded perspective view of the first adjustment piece and the wall mount of FIG. 17;

FIG. 19 is a perspective view of the first adjustment piece slid over a portion of the wall mount of FIG. 17; and FIG. 20 is a perspective view of the speaker mounting system of FIG. 17 with the first adjustment piece rotated into a locked orientation relative to the wall mount.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 2:
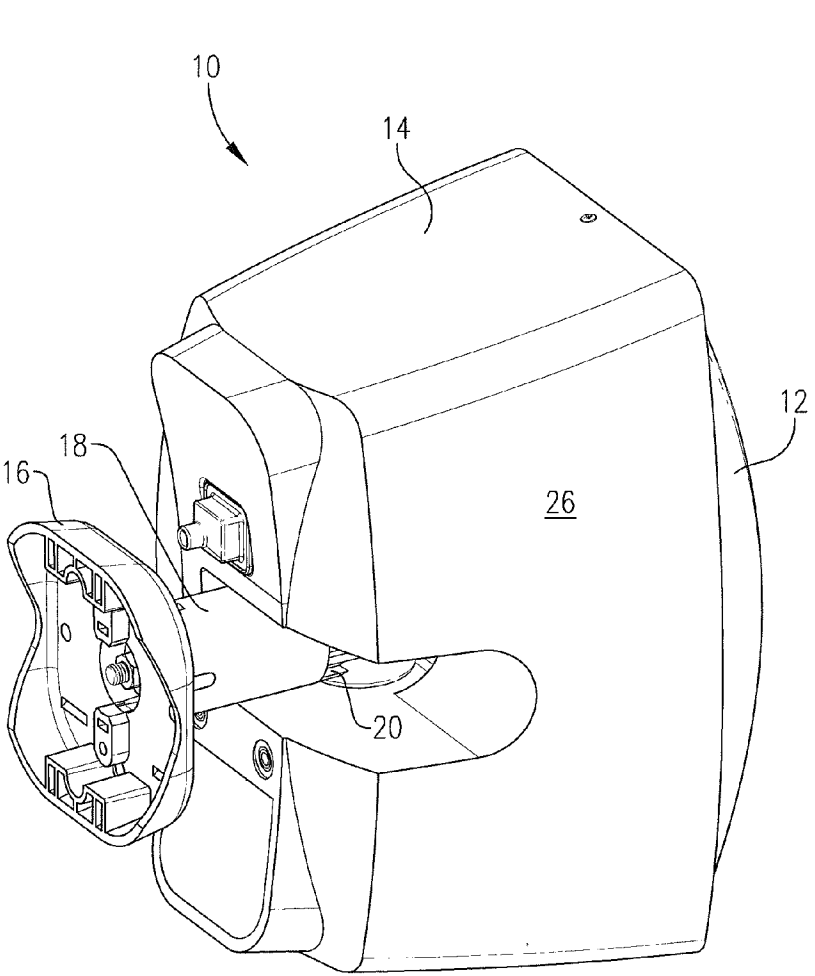
FIG. 2 is another perspective view of the speaker mounting system of FIG. 1.

A speaker mounting system 10 constructed in accordance with various embodiments of the invention is illustrated in FIGS. 1 and 2. The speaker mounting system 10 is configured to support an audio speaker 12 relative to a surface to which the speaker mounting system 10 is mounted and to permit the orientation of the speaker 12 to be selectively adjusted. Specifically, the speaker mounting system 10 may be configured to rotate or pivot the speaker 12 about two distinct axes.

The speaker mounting system broadly comprises a speaker housing 14 configured to house the speaker 12, a wall mount 16, and adjustment pieces 18,20 configured to couple the speaker housing 14 to the wall mount 16. The first adjustment piece 18 is fixed to or integral with the wall mount 16 and the second adjustment piece 20 is pivotable or rotatable relative to the speaker housing 14. The second adjustment piece 20 may also be axially slidable and rotatable relative to the first adjustment piece 18. The speaker mounting system 10 may further comprise at least one biasing member 22, such as a spring, configured to prevent and allow rotation of the second adjustment piece 20 relative to the first adjustment piece 18, and at least one locking mechanism 24 configured to prevent and allow rotation of the speaker housing 14 relative to the second adjustment piece 20.

As known in the art, the speaker 12 may include any device for generating frequencies in a range of human hearing. For example, the speaker 12 may include a magnet, core, voice coil, diaphragm, frame, and signal input terminals, as well as any other common components of a speaker. Furthermore, in some embodiments of the invention, the speaker 12 may include the speaker housing 14 and/or a separate speaker housing (not shown). Additionally or alternatively, the speaker 12 may include a plurality of speakers of identical or varying sizes and configurations supported by the speaker housing 14.

The speaker housing 14 may have an outer surface 26 and an inner surface 28 and may be an at least partially hollow part of any shape or configuration and may be made of plastic, composites, metal, wood, or any other suitable material for housing and supporting the speaker 12. In some embodiments of the invention, the speaker housing may be configured to receive the speaker 12, while in other embodiments of the invention, the speaker housing 14 may be any rigid frame configured to have a self-contained speaker with its own housing mounted thereto.

Figure 3:
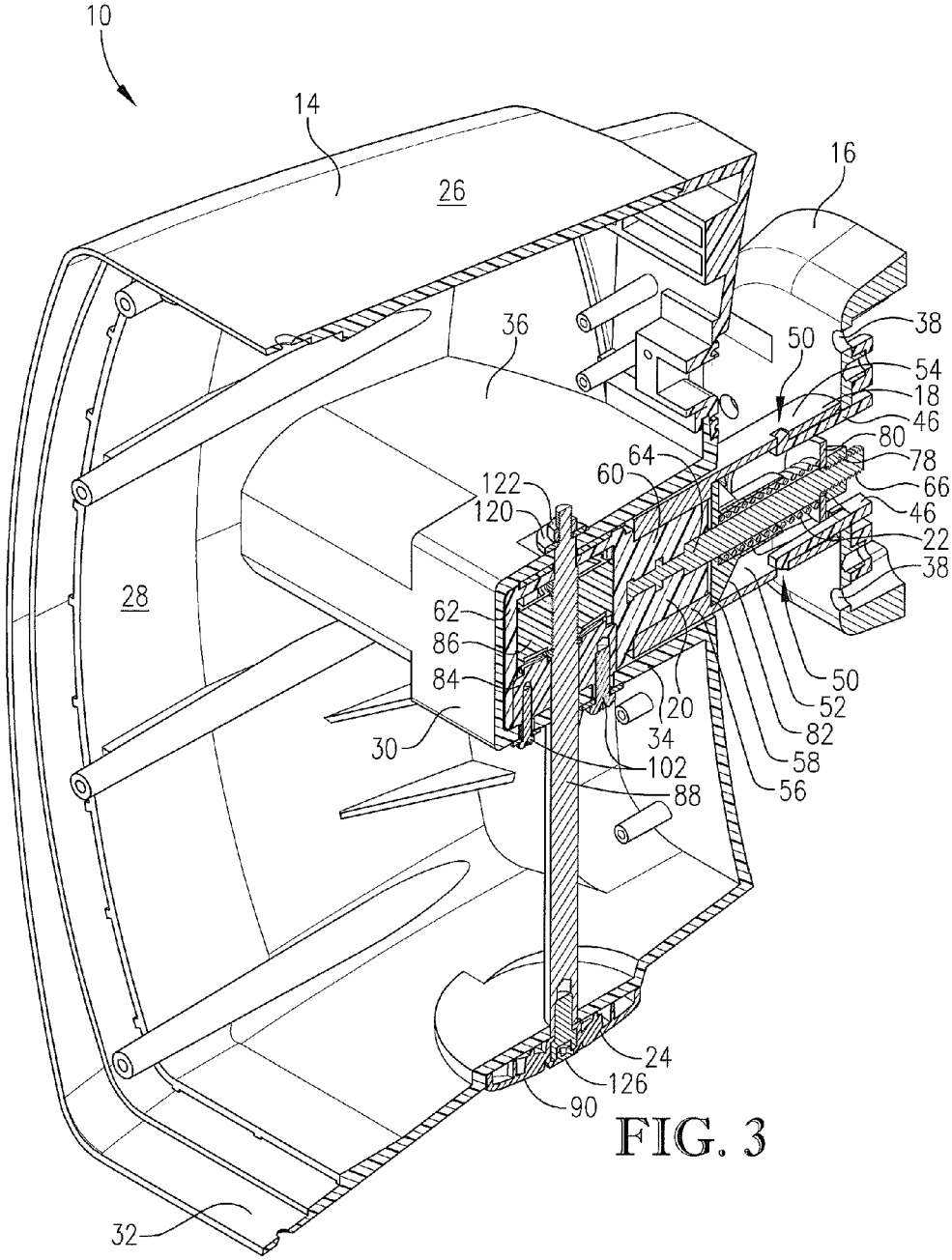
FIG. 3 is a cross-sectional perspective view of the speaker mounting system of FIG. 1.

In some embodiments of the invention, as illustrated in FIGS. 1-3, the speaker housing 14 may have a cavity or recessed portion 30 formed therein, sized and configured to allow the first and second adjustment pieces 18,20 to rotate and/or pivot in one or more directions relative to the speaker housing 14 or vice versa. For example, the recessed portion 30 may be a channel in the outer surface 26 of the speaker housing 14 configured to allow approximately 90-degrees of rotation of the second adjustment piece 20 about one axis of rotation. The recessed portion 30 may thereby limit the amount of rotation of one or more of the adjustment pieces 18,20 by a desired amount. Furthermore, various holes may be formed through the speaker housing 14, such as through or proximate to the recessed portion 30, to support or allow for attachment of various components of the speaker mounting system 10, as later described herein.

In some example embodiments of the invention, as illustrated in FIG. 2, the speaker housing 14 may have one or more outer walls 32 and its recessed portion 30 may have at least two opposing recess walls 34,36 extending inward from at least one of the outer walls 32. For example, the outer walls 32 may comprise four side outer walls formed into a box-like configuration and a back outer wall attached to edges of all four side outer walls. The speaker 12 may be mounted within the speaker housing 14 at a location opposite of the back outer wall, as illustrated in FIGS. 1 and 2. The recessed portion 30 may comprise the recess walls 34,36 forming a channel or cavity of any shape and configuration within which the first and second adjustment pieces 18,20 may be positioned. Specifically, the recess walls may comprise a first recess wall 34 and a second recess wall 36 extending inward from an opening formed into or through one of the side outer walls and/or the back outer wall. The first and second recess walls 34,36 may also be joined with each other by a back wall extending therebetween, such as a curved or substantially L-shaped wall configured to limit rotational movement of the first and second adjustment pieces 18,20, as later described herein.

Figure 4:
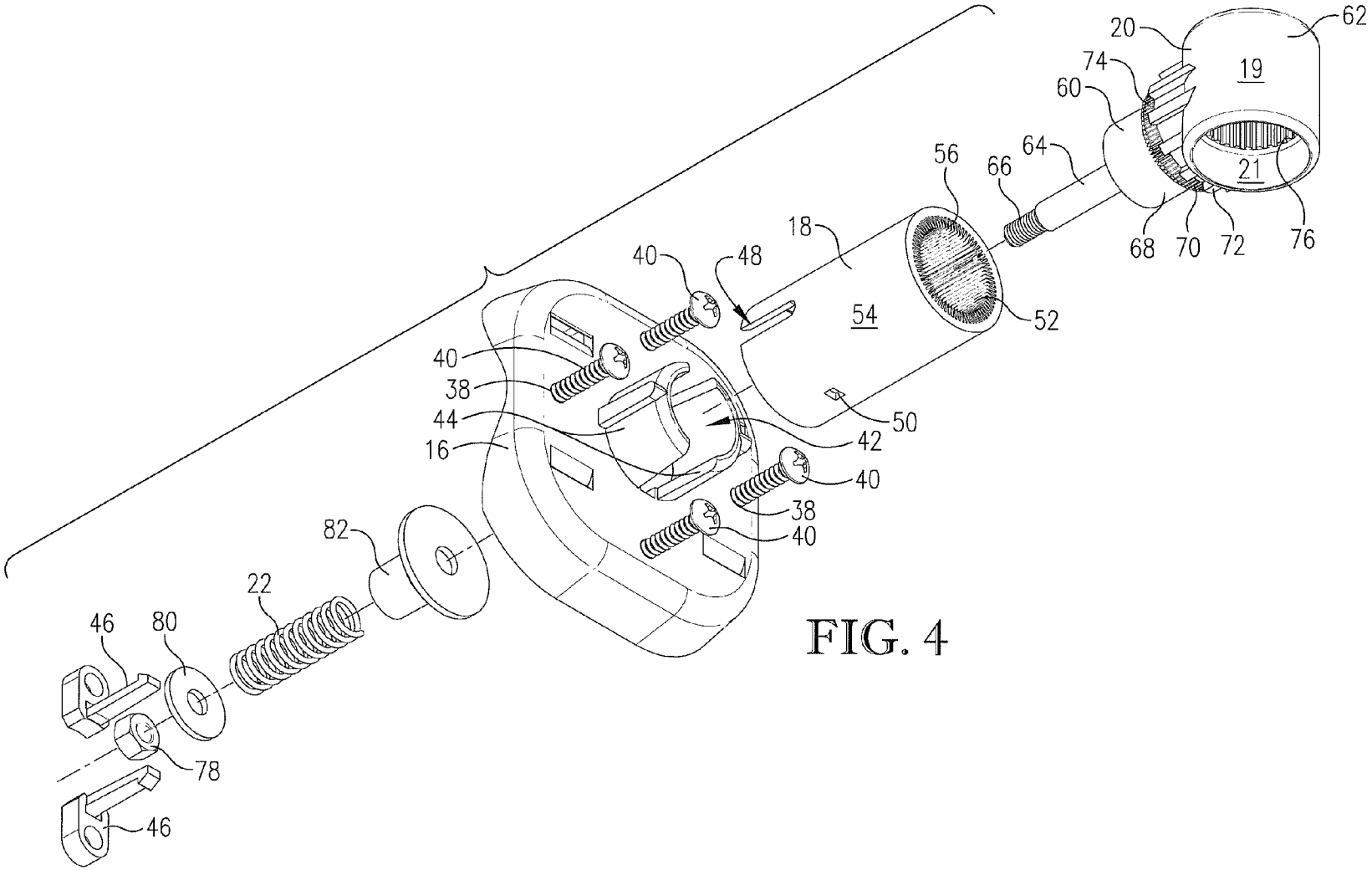
FIG. 4 is an exploded perspective view of a wall mount, first adjustment piece, and second adjustment piece of the speaker mounting system of FIG. 1.
Figure 6:
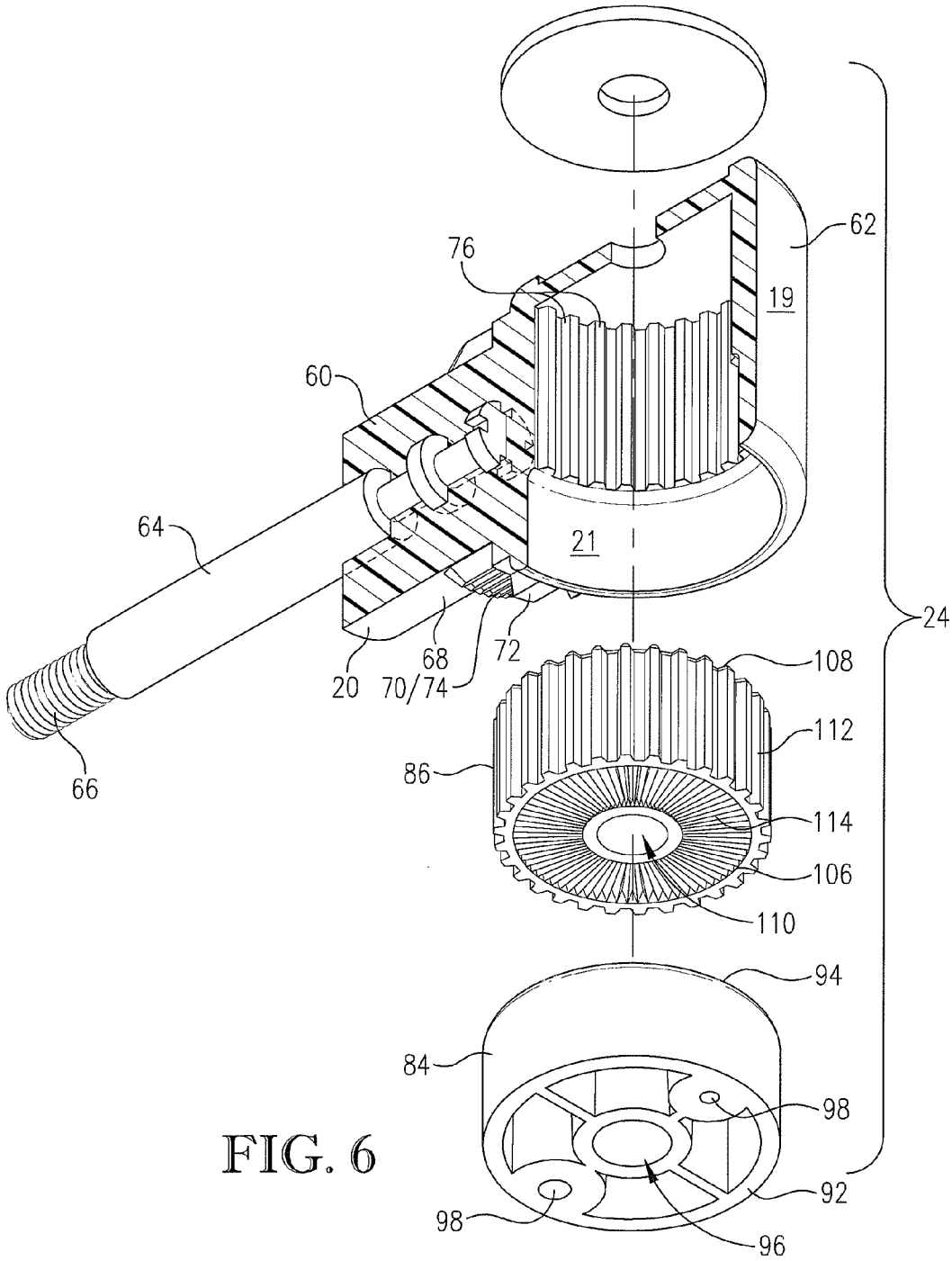
FIG. 6 is an exploded cross-sectional perspective view of the second adjustment piece and first and second engagement parts of the locking mechanism of FIG. 5.

The wall mount 16, as illustrated in FIGS. 3 and 4, may be any rigid mounting component of any size and configuration and may be made of plastic, composites, metal, wood, or any other suitably rigid materials. In some embodiments of the invention, the wall mount 16 may be made of the same material as the speaker housing 14. As illustrated in FIGS. 4 and 6, the wall mount 16 may have a greater length and/or width than its depth. The wall mount 16 may have one or more holes 38 formed therein through which mechanical fasteners 40 may be inserted. The mechanical fasteners 40, such as screws or bolts, may be sized and configured to be inserted through the holes and into a mounting surface, such as a wall, thereby fastening the wall mounting system 10 to the mounting surface. However, any method of fastening the wall mount 16 to a mounting surface may be employed without departing from the scope of the invention.

The wall mount 16 may have an attachment opening 42 formed therethrough which may be configured to provide clearance for portions of the adjustment pieces 18,20 and/or other components joined with the adjustment pieces 18,20, as later described herein. The wall mount 16 may also comprise and/or be attached to various attachment protrusions 44 and attachment brackets 46, as illustrated in FIG. 4. For example, the attachment protrusions 44 may be integrally formed with the wall mount 16, may extend from a peripheral boundary of the attachment opening 42, and may be configured to provide alignment of the first adjustment piece 18 relative to the wall mount 16. In the embodiment of the invention illustrated in FIG. 4, the attachment protrusions 44 comprise raised portions shaped and configured to mate with indentations or cavities 48 formed into the first adjustment piece 18. Likewise, the attachment brackets 46 may be configured to mate with attachment holes 50 formed through the first adjustment piece 18. For example, the attachment brackets 46 may be substantially L-shaped, with a first portion configured to be screwed into a side of the wall mount 16 facing away from the speaker 12 and a second portion configured to extend through the attachment opening 42 and engage with the attachment holes 50 of the first adjustment piece 18. However, any method for fixing the wall mount 16 to the first adjustment piece 18 may be used. For example, in some alternative embodiments of the invention, the wall mount 16 and the first adjustment piece 18 may be integrally formed.

In some alternative embodiments of the invention, as illustrated in FIGS. 17-20, the wall mount 16 may comprise additional locking features, such as locking tabs 51 and/or a locking screw 53, for securing the first adjustment piece 18 to the wall mount 16. For example, the attachment protrusions 44 may have one or more protrusions or locking tabs 51 extending therefrom on an outward-facing surface of the attachment protrusions, as illustrated in FIGS. 17 and 18. Furthermore, the cavities 48 formed into the first adjustment piece 18 may be sized and shaped to allow the locking tabs 51 to slide therethrough and then be nested therein by a slight rotation of the first adjustment piece, as illustrated in FIGS. 19 and 20. Specifically, the cavities 48 may be substantially L-shaped, such that the as the first adjustment piece 18 is slid over the attachment protrusions, the locking tabs 51 slide through a first portion of the L-shaped cavities, as illustrated in FIG. 19. Then, the first adjustment piece 18 may be rotated slightly, sliding the locking tabs 51 into a second portion of the L-shaped cavities, as illustrated in FIG. 20. As noted above, the additional locking features may also comprise a locking screw configured to be inserted through the cavities 48 into the first adjustment piece 18, as illustrated in FIG. 20, to prevent any unwanted rotation of the first adjustment piece 18 relative to the wall mount 16.

Figure 5:
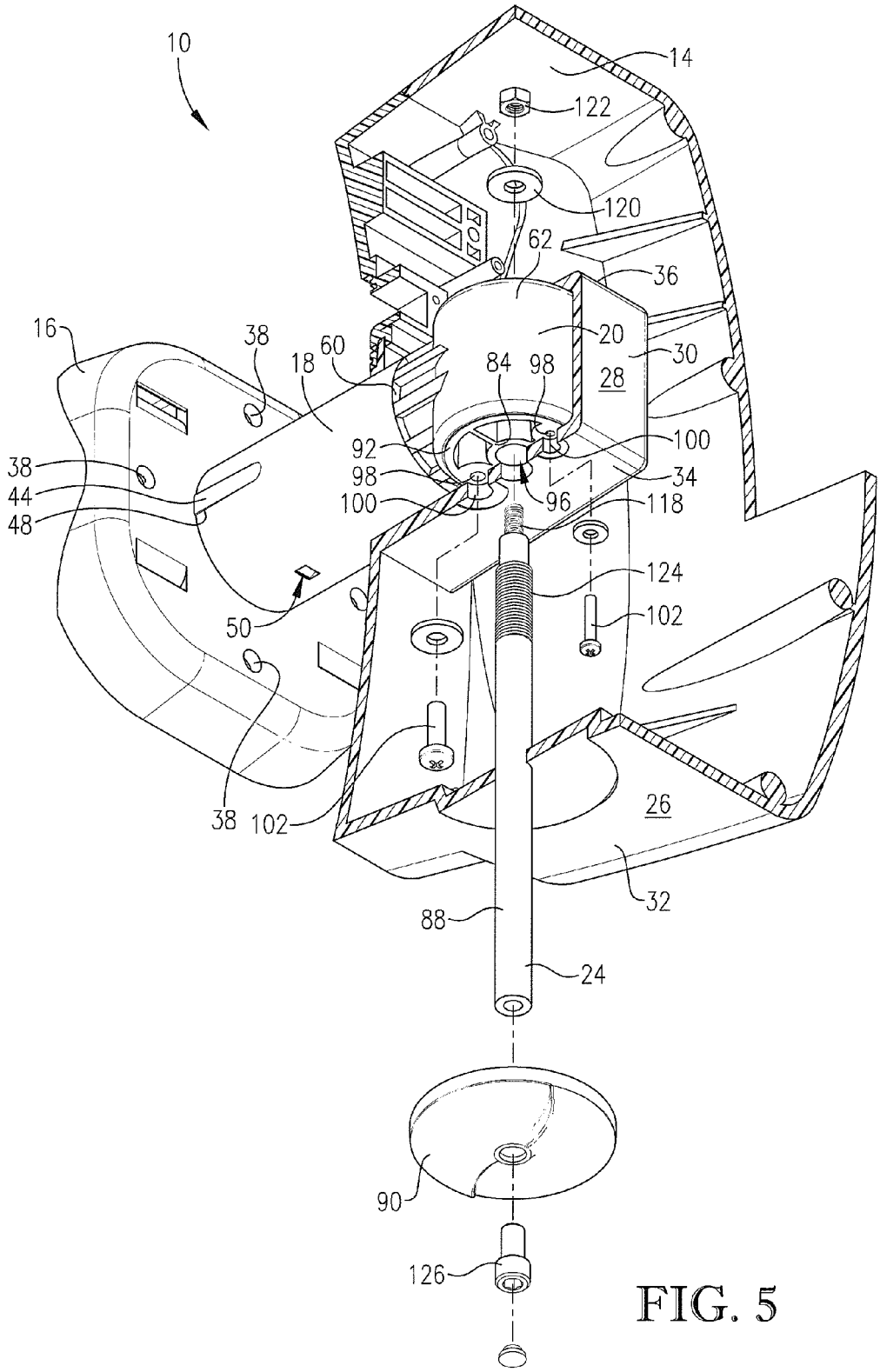
FIG. 5 is an exploded breakaway perspective view of the speaker mounting system of FIG. 1 illustrating assembly of a locking mechanism of the speaker mounting system.

The first adjustment piece 18, as illustrated in FIGS. 3-5, may be any rigid component of any size and configuration and may be made of plastic, composites, metal, wood, or any other suitably rigid materials. In some embodiments of the invention, the first adjustment piece 18 may be made of the same material as the speaker housing 14 and/or the wall mount 16. The first adjustment piece 18 may have one or more cavities 48 and/or attachment holes 50 formed therein for fixedly attaching to the wall mount 16, as described above. As illustrated in FIGS. 3, 4, and 6, the first adjustment piece 18 may be a hollow tube of any cross-sectional size, shape and configuration, having an inner surface 52 and an outer surface 54. The inner surface 52 may have a plurality of interlocking features 56 extending radially inward therefrom, as illustrated in FIG. 6. For example, the interlocking features 56 may be protrusions, teeth, or ribs configured to mate with another set of interlocking features, as later described herein, to prevent rotation of the first adjustment piece 18. In some embodiments of the invention, the interlocking features 56 may be a series of ribs protruding axially inward from the inner surface 52 of the first adjustment piece 18 and arranged substantially parallel to a center axis of the first adjustment piece 18.

In some embodiments of the invention, the interlocking features 56 may protrude from a first portion of the inner surface 52 proximate to the speaker housing 14, but may be omitted from a second portion of the inner surface 52 proximate to the wall mount 16, as illustrated in FIG. 3. The interlocking features 56 thereby form a shoulder 58 between the first and second portions which may interact with the biasing member 22, as later described herein. Specifically, the biasing member 22 may be compressed with force provided by the shoulder 58 when the first adjustment piece 18 is slid axially away from the second adjustment piece 20.

The second adjustment piece 20, as illustrated in FIGS. 3-7 may have an outer surface 19 and an inner surface 21, may have any size and configuration, and may be made of any rigid material such as plastic, composites, metal, wood, or any other suitably rigid materials. In some embodiments of the invention, the second adjustment piece 20 may be made of the same material as the speaker housing 14, the wall mount 16, and/or the first adjustment piece 20. The second adjustment piece 20 may comprise a solid portion 60 which is substantially solid throughout and a hollow portion 62 that is at least partially hollow throughout and/or has a cavity formed therein. Specifically, the outer surface 19 may include outer surfaces of the solid portion 60 and the hollow portion 62, and the inner surface 21 may include inner surfaces within the hollow portion 62. However, in some alternative embodiments of the invention, the solid portion 60 may be hollow and/or have one or more cavities formed therein. In some embodiments of the invention, the solid and hollow portions 60,62 may each be substantially cylindrical with axes arranged at substantially 90-degree angles relative to each other. The solid and hollow portions 60,62 may be integrally formed with each other or may be mechanically attached or otherwise bonded together.

Figure 7:
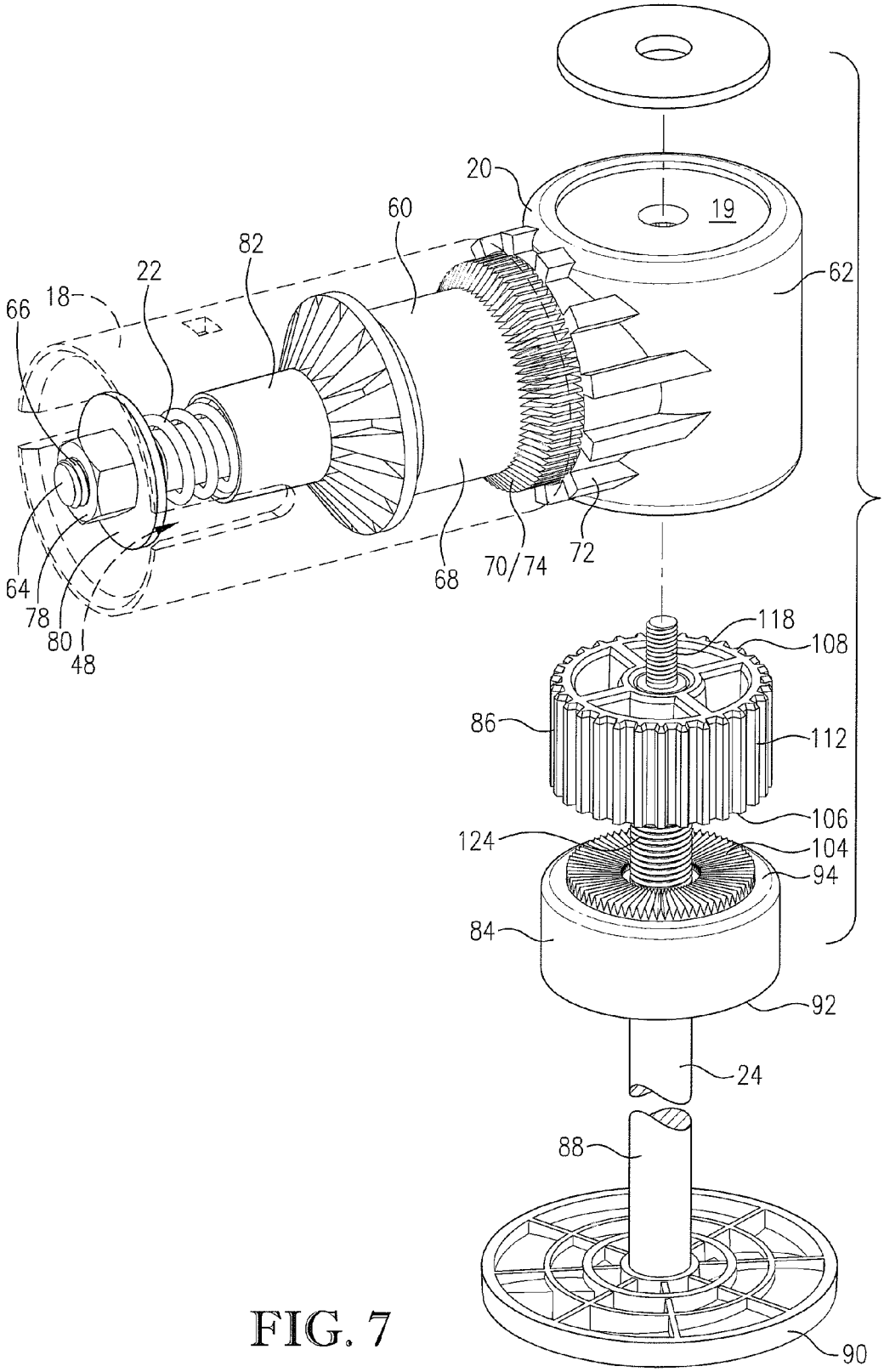
FIG. 7 is an exploded perspective view of the first and second adjustment pieces and the locking mechanism of FIG. 5.

The solid portion 60, as illustrated in FIGS. 4, 6, and 7, may comprise or be fixed to a support rod 64. For example, the solid portion 60 may be molded around a portion of the support rod 64, securing it thereto. Alternatively, the support rod 64 may be an integral component of the solid portion 60, extending therefrom in a direction toward the wall mount 16. In some embodiments of the invention, the support rod 64 may be made of the same or stronger material than the solid portion 60. For example, the support rod 64 may be made of metal while the solid portion 60 of the second adjustment piece 20 may be made of plastic. The support rod 64 may provide an axial guide for the biasing member 22, as later described herein, and may comprise screw threads 66 at or near an end thereof positioned proximate to the wall mount 16.

As illustrated in FIGS. 4,6 and 7, the outer surface 19 of the solid portion 60 may have a first segment 68 and a second segment 70 configured to slide into the first adjustment piece 18, and a third segment 72 configured to prevent axial sliding of the first adjustment piece 18 beyond the third segment 72 of the second adjustment piece 18. The first segment 68 may be sized and configured to allow the first adjustment piece 18 to rotate relative to the first segment 68. For example, a diameter of the first segment 68 may be equal to or slightly smaller than a diameter of the first adjustment piece 18 as measured between most inwardly-located points of the interlocking features 56. The second segment 70 may include interlocking features 74 extending therefrom and configured to interlock or interdigitate with the interlocking features 56 of the first adjustment piece 18, preventing rotation between the first and second adjustment pieces 18,20, but allowing an axial sliding motion between the first and second adjustment pieces 18,20. For example, the interlocking features 74 may be a series of ribs arranged parallel to a center axis of the solid portion 60 and extending axially outward from the outer surface 19 of the solid portion 60. As later described herein, the axial position of the solid portion 60 relative to the first adjustment piece 18 (adjusted via axial sliding) determines whether the solid portion 60 is allowed to axially rotate relative to the first adjustment piece 18 or is locked from axial rotation.

The third segment 72 may be of any size and configuration to abut an end of the first adjustment piece 18, limiting its axial movement any further toward the hollow portion 62 of the second adjustment piece. Specifically, the largest diameter of the third segment 72 may be equal to or greater than the smallest diameter of the first adjustment piece 18. The third segment 72 may be shaped to engage with the outer surface 19 of the hollow portion 62 and/or may be integrally formed therewith. For example, if the hollow portion 62 is cylindrical, the third segment 72 may have an arched end abutting and or integral with the outer surface 19 of the hollow portion 62, as illustrated in FIG. 5.

The inner surface 21 of the hollow portion 62 may have interlocking features 76 extending inward therefrom, as illustrated in FIGS. 4 and 6. The interlocking features 76 may be sized and configured to interlock or interdigitate with a component of the locking mechanism 24, preventing axial rotation but allowing axial sliding of the component, as later described herein. Specifically, the interlocking features 76 may be a series of ribs parallel to a center axis of the substantially cylindrical hollow portion 62.

The biasing member 22, as illustrated in FIGS. 3, 4, and 7, may be a spring or any operationally-equivalent component configured to bias the first adjustment piece 18 relative to the second adjustment piece 20 in a locked configuration. Specifically, the biasing member 22 may be slid onto and/or wrapped around the support rod 64. A threaded nut 78 and/or a washer 80 may be screwed onto or otherwise attached to an end of the support rod 64 in such a manner as to prevent a first end of the biasing member 22 from sliding beyond the threaded nut 78 and/or washer 80. Specifically, the biasing member 22 may be slidable, compressible, and/or expandable along a center axis of the support rod 64 between the shoulder 58 of the first adjustment piece 18 and the threaded nut 78 and/or washer 80. In some embodiments of the invention, as illustrated in FIGS. 6 and 7, a sleeve 82 may be slid over the biasing member 22 to assist in alignment of the biasing member and to limit any non-axial movement of the biasing member 22. For example, the sleeve 82 may be substantially cylindrical and may have a bottom wall abutting the shoulder 58 and having a hole formed therethrough through which the support rod 64 may extend, as illustrated in FIG. 3. In this embodiment of the invention, the biasing member 22 may rest between the bottom wall of the sleeve 82 and the threaded nut 78 and/or washer 80.

The locking mechanism 24, as illustrated in FIGS. 3 and 5-7, may comprise a first engagement part 84, a second engagement part 86, a locking shaft 88, and a knob 90. The components of the locking mechanism 24 may be made of plastic, composites, metal, wood, or any combination thereof. The first engagement part 84 may be sized and configured to fit within the hollow portion 62 of the second adjustment piece 20 and fixed to the speaker housing 14 within the recessed portion 30. The second engagement part 86 may also be sized and shaped to fit within the hollow portion 62 of the second adjustment piece 20 and may be axially aligned with the first engagement part 84 about the locking shaft 88, as later described herein.

The first engagement part 84 may be substantially cylindrical in shape, having a first end 92 and a second end 94 opposite of the first end 92, as well as a shaft hole 96 formed therein, extending axially therethrough through which the locking shaft 88 may extend. The first end 92, as illustrated in FIGS. 5 and 6, may also have attachment holes 98 formed therein which may align with other attachment holes 100 formed into one of the recess walls 34,36 of the recessed portion 30 of the speaker housing 14. Specifically, the first end 92 may be attached to the first recess wall 34 of the speaker housing 14 by way of screws, bolts, or any other fasteners 102 inserted and/or screwed into the attachment holes 98,100 of the speaker housing 14 and/or the first end 92 of the first engagement part 84. The second end 94 of the first engagement part 84, as illustrated in FIG. 7, may comprise interlocking features 104 configured to interlock or interdigitate with features of the second engagement part 86, as later described herein and illustrated in FIG. 11. The interlocking features 104 of the second end 94 may be teeth or ribs radially spaced about a center axis of the first engagement part 84 and extending in a direction toward the second engagement part 86.

The second engagement part 86, as illustrated in FIGS. 6 and 7, may be substantially cylindrical in shape, having a first end 106 and a second end 108 opposite of the first end 106, as well as a shaft hole 110 formed therein, extending axially therethrough through which the locking shaft 88 may extend. An outer surface extending between the first and second ends 106,108 of the second engagement part 86 may comprise interlocking features 112 which may be positioned and configured to interlock or interdigitate with the interlocking features 76 of the hollow portion 62 of the second adjustment piece 20. As noted above, the interlocking features 76 and 112 may be designed and arranged to prevent axial rotation while allowing axial sliding of the of the second engagement part 86 relative to the second adjustment piece 20 and the locking shaft 88. Like the interlocking features 76, the interlocking features 112 may be a series of ribs parallel to a center axis of the second engagement part 86.

Figure 9:
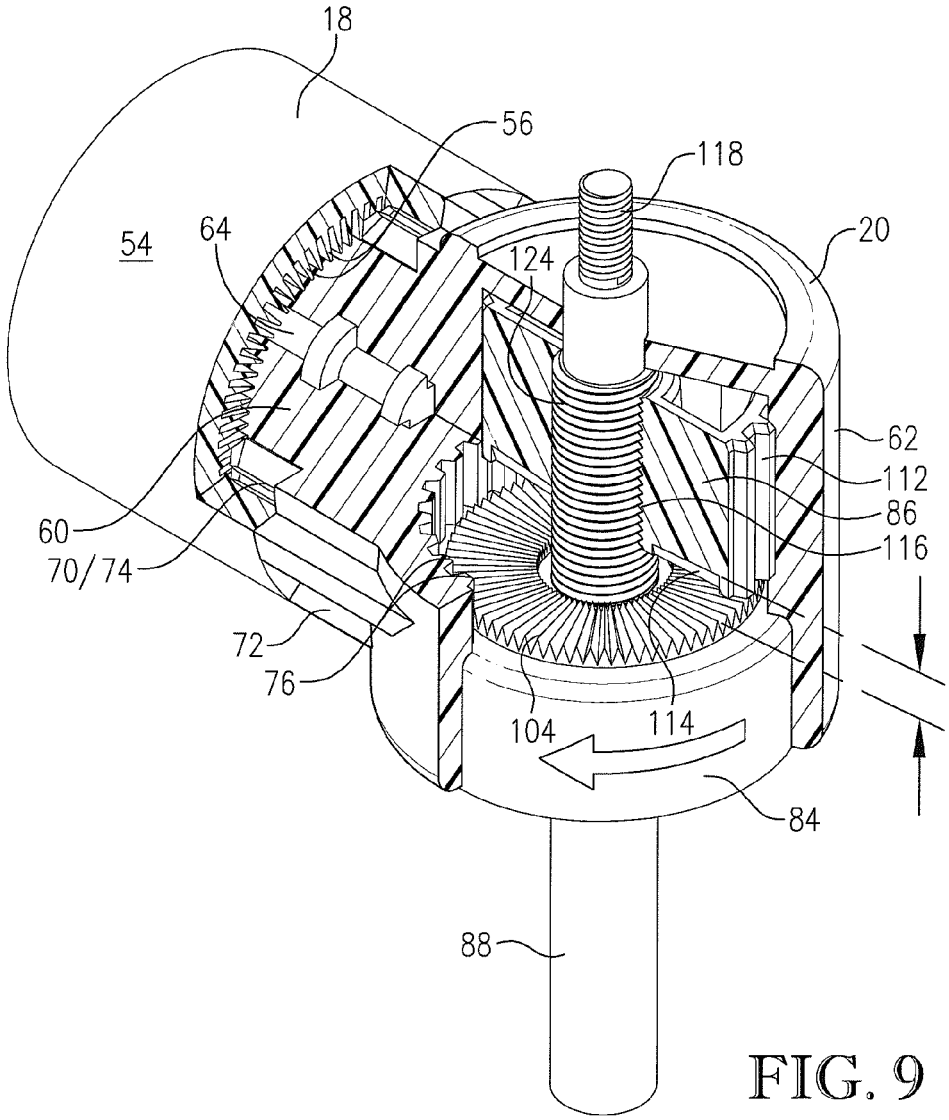
FIG. 9 is a fragmentary breakaway perspective view of the first and second adjustment pieces and the locking mechanism in an unlocked position, illustrating a direction of rotation of the first engagement part rotating relative to the second adjustment piece.
Figure 11:
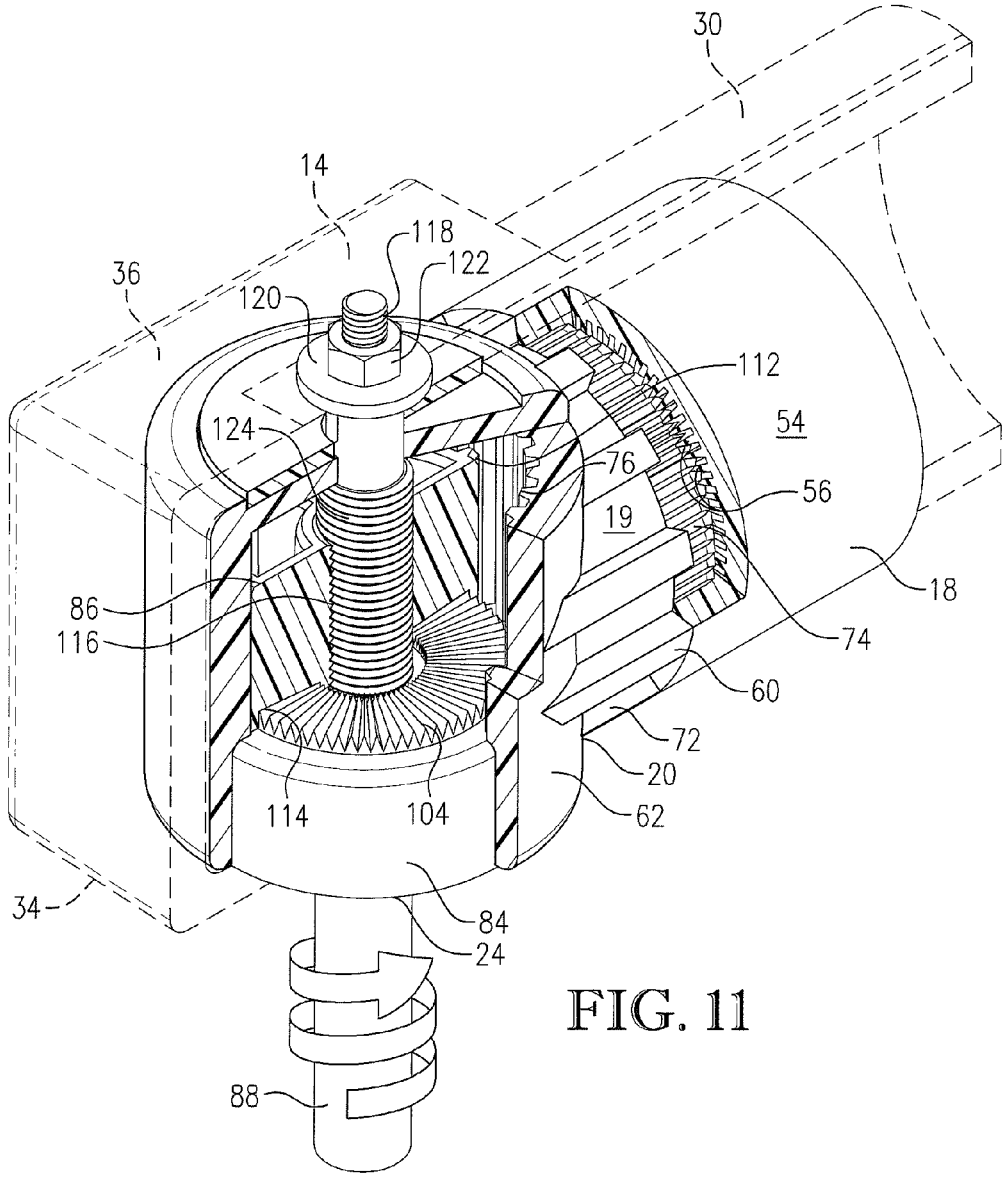
FIG. 11 is a fragmentary breakaway perspective view of the first and second adjustment pieces and the locking mechanism of FIG. 9 in a locked position, illustrating counterclockwise rotation of the locking shaft to actuate the second engagement part toward the first engagement part.

As illustrated in FIG. 6, the first end 106 of the second engagement part 86 may face the second end 94 of the first engagement part 84 and may comprise interlocking features 114 configured to interlock or interdigitate with the interlocking features 104 of the first engagement part 84. Specifically, the interlocking features 114 of the second engagement part 86 may be teeth or ribs radially spaced about a center axis of the second engagement part 86 and extending in a direction toward the first engagement part 84. An inner surface within the shaft hole 110 may also comprise screw threads 116, as illustrated in FIGS. 9 and 11, which may engage with the locking shaft 88, as later described herein.

The locking shaft 88, as illustrated in FIG. 5, may be an elongated shaft or rod which may be substantially cylindrical and configured to extend through a hole in one of the outer walls 32 of the speaker housing 14, a hole in the first recess wall 34 of the recessed portion 30 of the speaker housing 14, and a hole in the second recess wall 36 of the recessed portion 30 of the speaker housing 14 located opposite of the first recess wall 34 of the recessed portion 30, as illustrated in FIG. 4. The locking shaft 88 may also extend through shaft holes 96,110 of the first and second engagement parts 84,86, respectively.

As illustrated in FIGS. 3 and 5, the locking shaft 88 may comprise a first set of screw threads 118 configured to mate with a washer 120 and nut 122 between the second wall of the recessed portion 30 and the outer wall of the speaker housing 14. The first set of screw threads 118, washer 120, and nut 122 may be replaced with any protrusion extending from the locking shaft 88 or any other mechanical fastener configured to prevent the locking shaft 88 from being withdrawn from the hole in the second wall of the recessed portion 30 of the speaker housing 14. The locking shaft 88 may also comprise a second set of screw threads 124 sized and configured to engage screw threads 116 of shaft hole 110 in the second engagement part 86.

The knob 90, as illustrated in FIGS. 5 and 7, may be any handle, knob, or graspable part which may be fixed to the locking shaft 88 at an end outward of the speaker housing 14 proximate to the hole through the outer wall of the speaker housing 14. For example, mechanical fasteners 126 may cooperatively fix the knob 90 to the locking shaft 88, as illustrated in FIGS. 3 and 5. In some embodiments of the invention, the knob 90 may be raised or have grip protrusions configured in such a manner that manual turning toward a locked configuration (e.g., clockwise) may be facilitated, but manual turning toward an unlocked configuration (e.g., counterclockwise) may be more difficult.

To mount the speaker mounting system 10 to a wall, a user may first secure the wall mount 16 to a wall using mechanical fasteners 40, such as the four screws illustrated in FIG. 4. Then the user may slide the first adjustment piece 18 onto a portion of the wall mount 16, such as the attachment protrusions 44, as illustrated in FIG. 4 or alternatively in FIGS. 17-20. Next, the user may secure the first adjustment piece 18 to the wall mount by insertion of the attachment brackets 46 into the attachment holes 50, as illustrated in FIGS. 3-4, and/or by rotating the first adjustment piece 18 relative to the attachment protrusions 44, as illustrated in FIGS. 19-20. Note that the mounting methods described herein are merely examples and the speaker mounting system 10 may be mounted to any surface using a variety of methods not disclosed herein without departing from the scope of the invention.

Figure 10:
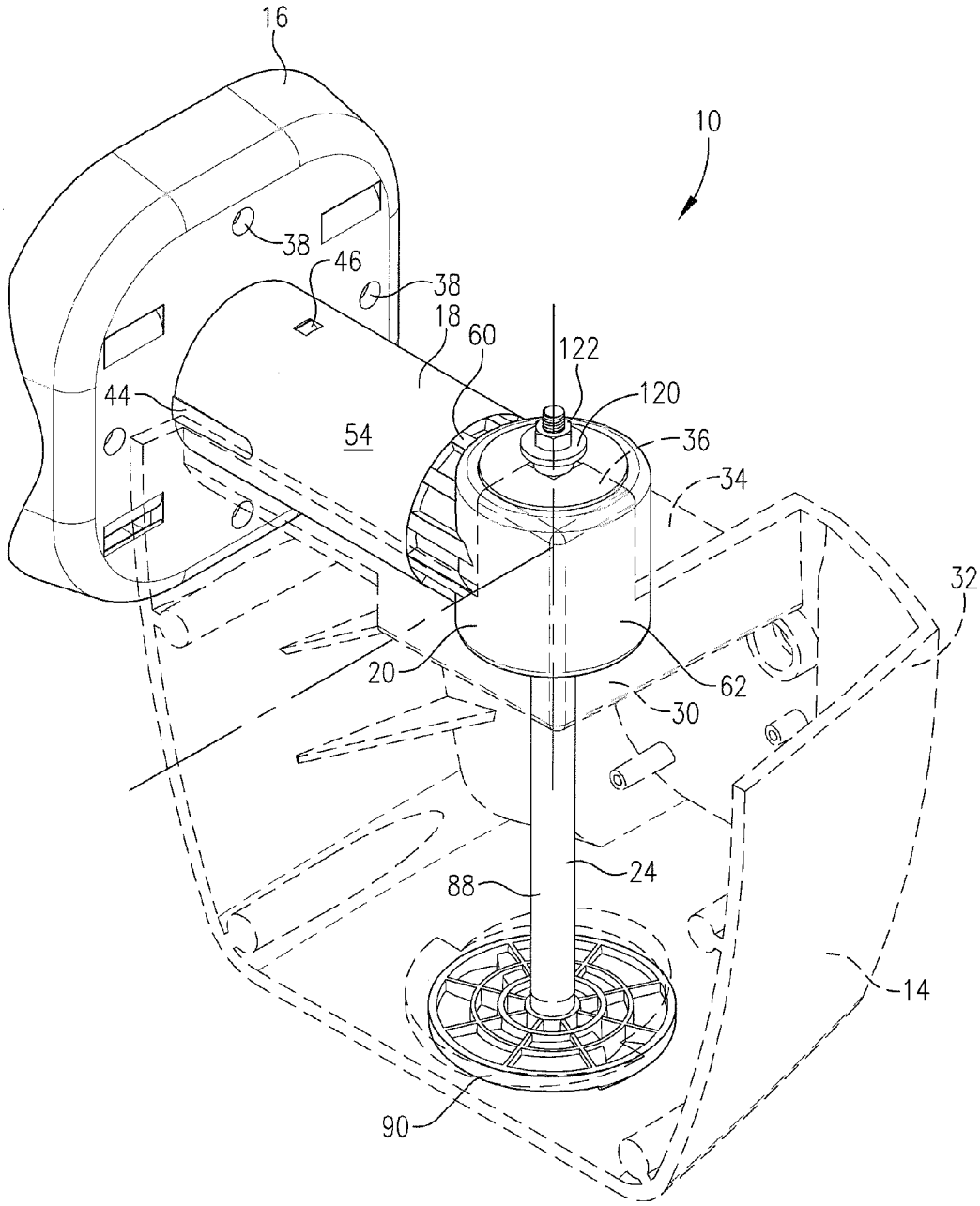
FIG. 10 is a breakaway perspective view of the mounting system of FIG. 8 with the speaker housing positioned in its resulting new orientation after being rotated as illustrated in FIG. 8.
Figure 12:
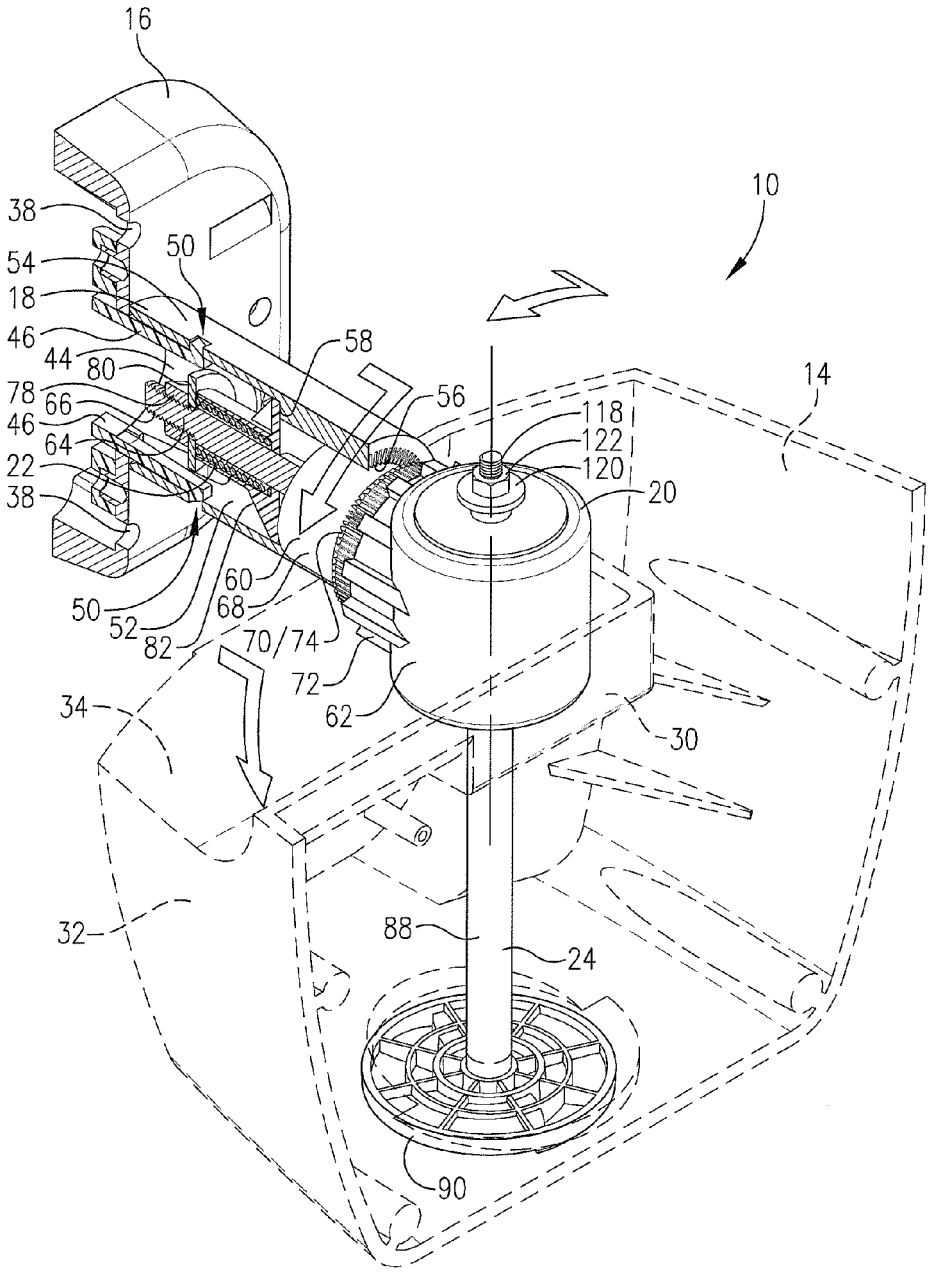
FIG. 12 is a break-away perspective view of the mounting system of FIG. 1 illustrating a direction of rotation of the second adjustment piece relative to the first adjustment piece and mount, with the second adjustment piece slid away from the first adjustment piece.
Figure 13:
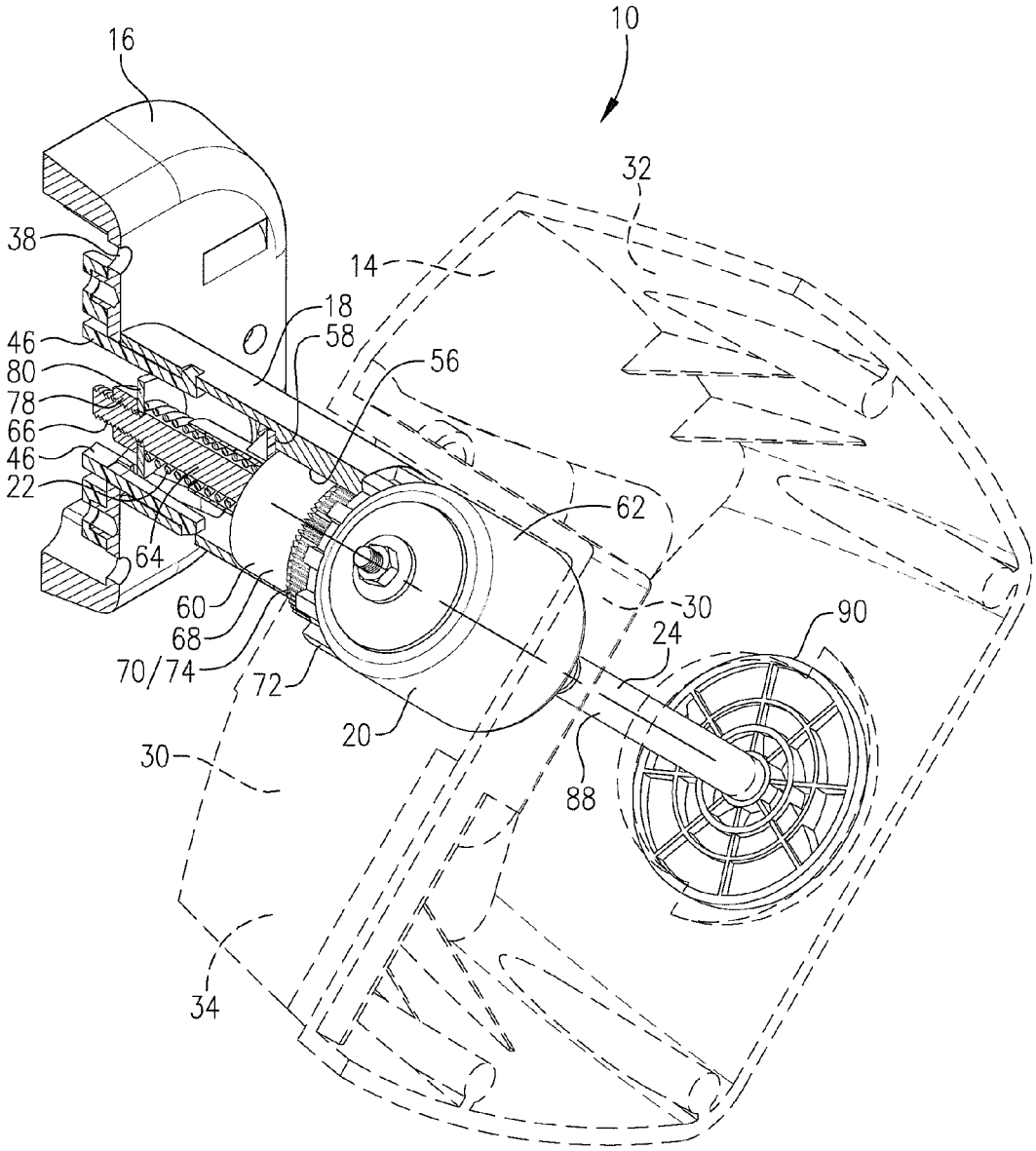
FIG. 13 is a break-away perspective view of the mounting system of FIG. 12, with the second adjustment piece released and biased against the first adjustment piece, thereby locking the second adjustment piece and the attached speaker housing in a resulting new orientation after being rotated as illustrated in FIG. 12.

In use, the speaker housing 14 is selectively and independently rotatable about a first axis perpendicular to the wall mount 16 and selectively and independently rotatable or pivotable about a second axis that is parallel to the wall mount 16. Specifically, the speaker housing 14 may be rotatably actuated along the center axis of the locking shaft 88, as illustrated in FIGS. 9-10, and/or rotatably actuated about the support rod 64 fixed to the second adjustment piece 20, as illustrated in FIGS. 12-13. Furthermore, the speaker housing 14 may be locked or otherwise prevented from rotation about the locking shaft 88 while being allowed to rotate about the support rod 64 and/or the speaker housing 14 may locked or prevented from rotation about the support rod 64 while being allowed to rotate about the locking shaft 88. Thus, the speaker mounting system 10 may allow for independent actuation of the housing about two separate axes. However, in some embodiments of the invention, the speaker housing 14 may also be allowed to rotate about the support rod 64 and the locking shaft 88 simultaneously.

The speaker mounting system 10 allows the speaker 12 to be angled in a variety of positions within an x, y, and/or z axis, as illustrated in FIGS. 14*a*-16*c*. For example, FIGS. 14*a*-14*c* illustrate the speaker housing 14 positioned at different angles relative to the second adjustment piece 20 when pivoted or rotated about the locking shaft 88. FIGS. 15*a*-15*c* also illustrate the speaker housing positioned at different angles relative to the second adjustment piece 20 when pivoted or rotated about the locking shaft 88. However, note that in FIGS. 15*a*-15*c*, the second adjustment piece 20 was rotated about an axis corresponding to the support rod 64 to a new orientation relative to the first adjustment piece 18 and wall mount 16 compared with the orientation of the second adjustment piece 20 in FIGS. 14*a*-14*c*. Likewise, FIGS. 16*a*-16*c* illustrate the second adjustment piece 20 at yet another rotational orientation relative to the first adjustment piece 18, different from the orientations illustrated in FIGS. 14*a*-14*c* and the orientations illustrated in FIGS. 15*a*-15*c*. FIGS. 16*a*-16*c* also illustrate the speaker housing positioned a different angles relative to the second adjustment piece 20 when pivoted or rotated about the locking shaft 88.

To rotate the speaker housing 14 about the axis of the support rod 64, the speaker housing 14, second adjustment piece 20, and the support rod 64 may be actuated or pulled away from the wall mount 16 and the first adjustment piece 20 into an unlocked configuration, as illustrated in FIG. 12. This may cause the threaded nut 78 and/or a washer 80 to compress the biasing member 22 against the shoulder 58 of the first adjustment piece 18 and/or the bottom wall of the sleeve 82. Furthermore, this actuation may also separate interlocking features 56 of the first adjustment piece 18 and interlocking features 74 of the second adjustment piece 20, allowing the second adjustment piece 20 to rotate relative to the first adjustment piece 18, as illustrated in FIG. 12. Specifically, pulling the first and second adjustment pieces 18,20 away from each other allows the locking features 56 of the first adjustment piece 18 to rotate about the first segment 68 of the solid portion 60 of the second adjustment piece 20.

Once the actuation force applied to pull the speaker housing 14, second adjustment piece 20, and/or the support rod 64 away from the wall mount 16 is released, the biasing member 22 may be designed and configured to press the threaded nut 78 and/or a washer 80 in a direction toward the wall mount 16, thereby retracting the support rod 64 and the second adjustment piece 20 back into a locked configuration, as illustrated in FIG. 13. Specifically, in the locked configuration, the interlocking features 56 of the first adjustment piece 18 engage or interdigitate with the interlocking features 74 of the second adjustment piece 20.

To rotate the speaker housing 14 about the axis of the locking shaft 88, the locking mechanism 24 may be actuated to an unlocked position, as illustrated in FIG. 9. The locking mechanism 24 may be moved from a locked position, as illustrated in FIG. 11, into the unlocked position, as illustrated in FIG. 9, by rotatably actuating the knob 90 by hand and/or by some other electrical and/or mechanical means, which may rotate the locking shaft 88 relative to the speaker housing 14, the first engagement part 84, and the second engagement part 86. Remember that the interlocking features 76 of the hollow portion 62 interdigitate with the interlocking features 112 of the second engagement part 86 to prevent rotation of the second engagement part 86. Therefore, the rotating motion of the locking shaft 88 causes the second set of screw threads 124 to "unscrew" from the screw threads 116 of the shaft hole 110 in the second engagement part 86 (which is being prevented from rotating). Note that, in general, as one threaded component unscrews from another threaded component (such as the locking shaft 88 from the second engagement part 86), at least one of the components slides or moves laterally relative to the other component along their shared axis. Therefore, because axial sliding of the locking shaft 88 is limited or prevented by the washer 120 and nut 122 abutting the second recess wall 36 of the speaker housing 14, as the locking shaft 88 is unscrewed from the second engagement part 86, the second engagement part 86 axially moves toward the second recess wall 36 of the recessed portion 30 of the speaker housing 14 and/or the washer 120 and nut 122. So while the rotating of the second engagement part 86 is prevented by the interlocking features 76 and 112, lateral sliding of the second engagement part 86 relative to the second adjustment piece 20 and its interlocking features 76 is allowed.

Figure 8:
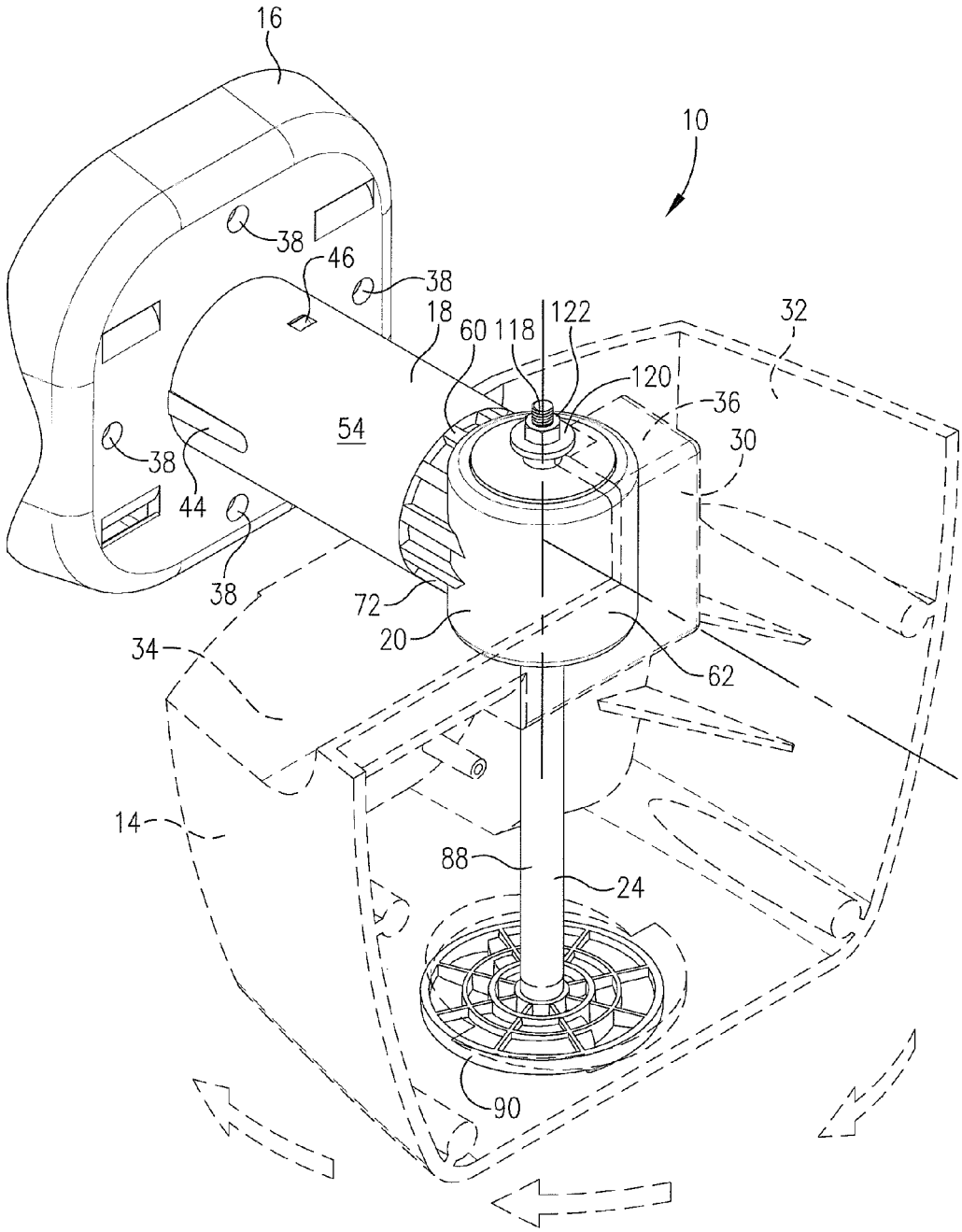
FIG. 8 is a break-away perspective view of the mounting system of FIG. 1 illustrating clockwise rotation of the speaker housing about a locking shaft of the locking mechanism.

Therefore, in some embodiments of the invention, counterclockwise rotating of the locking shaft 88 may cause the second engagement part 86 to move toward the second recess wall 36 of the recessed portion 30. Because the first engagement part 84 is fixed to the first recess wall 34 of the recessed portion 30 of the speaker housing 14, this movement also causes the second engagement part 86 to move away from the first engagement part 84, thereby disengaging their respective interlocking features 104,114. Disengaging the interlocking features 104,114 of the first and second engagement parts 84,86 allows rotation of the first engagement part 84 and the speaker housing 14 relative to the second engagement part 86 and the second adjustment piece 20. Specifically, the first engagement part 84 fixed to the housing 14 may rotate within the hollow portion 62 of the second adjustment piece 20. This rotation of the speaker housing is illustrated in FIG. 8, with the housing in a first orientation, and in FIG. 10, with the housing in a second orientation after rotating about the center axis of the locking shaft 88. Finally, to place the locking mechanism 24 back into the locked configuration, the locking shaft 88 may again be rotated as illustrated in FIG. 11, thereby actuating the first and second engagement parts 84,86 into engagement with each other.

Although embodiments of the invention have been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

Having thus described various embodiments of the invention, what is claimed as a new and desired to be protected by Letters Patent includes the following:

1. A speaker mounting system comprising:

a speaker housing configured to house or attach to a speaker;

a wall mount configured to be mechanically fastened to a support surface;

one or more adjustment pieces actuatably connecting the speaker housing to the wall mount and permitting the speaker housing to be selectively and independently rotatable about a first axis perpendicular to the wall mount and selectively and independently rotatable or pivotable about a second axis that is parallel to the wall mount, wherein the adjustment pieces comprise:

a first adjustment piece fixed to the wall mount, and a second adjustment piece having a hollow portion, wherein the second adjustment piece is slidably and rotatably attached to the first adjustment piece and pivotally attached to the speaker housing, wherein the second adjustment piece is configured to laterally slide toward and away from the wall mount and to rotate about the first axis, wherein the speaker housing is configured to rotate or pivot relative to the second adjustment piece about the second axis; and a locking mechanism configured to selectively prevent and allow rotation of the speaker housing relative to the second adiustment piece, the locking mechanism being shiftable between a first position and a second position relative to the second adjustment piece, wherein the locking mechanism is configured for fixing the second adjustment piece relative to the speaker housing in the first position, wherein the speaker housing is pivotable relative to the second adjustment piece about the axis perpendicular to the center axis when the locking mechanism is in the second position, wherein the locking mechanism includes:

a first engagement part fixed to the speaker housing and protruding within the hollow portion of the second adjustment piece, a locking shaft extending through the first engagement part and the hollow portion of the second adjustment piece and comprising screw threads thereon, and a second engagement part positioned within the hollow portion of the second adjustment piece adjacent the first engagement part, the second engagement part having an opening formed therethrough with threads formed therein, wherein the threads within the opening of the second engagement part are engaged with the screw threads on the locking shaft, wherein the second engagement part is configured to engage and disengage with the first engagement part by clockwise and counterclockwise rotation of the shaft.

2. The system of claim 1, wherein the first and second adjustment pieces are biased to lock rotation of the first adjustment piece relative to the second adjustment piece, wherein the second adjustment piece is rotatable relative to the first adjustment piece when the second adjustment piece is pulled or pushed away from or toward the first adjustment piece in an axial direction along the first axis.

3. The system of claim 2, wherein the first adjustment piece comprises a first set of interlocking features and the second adjustment piece comprises a second set of interlocking features configured to interdigitate with the first set of interlocking features when the first and second adjustment pieces are biased to lock rotation and configured to disengage with the first set of interlocking features when the second adjustment piece is pulled or pushed away from or toward the first adjustment piece.

4. The system of claim 1, wherein the second adjustment piece comprises a first set of interlocking features protruding within the hollow portion thereof and the second engagement part comprises a second set of interlocking features protruding outward therefrom and interdigitating with the first set of interlocking features, wherein the first and second set of interlocking features are configured to limit movement of the second engagement part to axial movement relative to the locking shaft and to prevent rotational movement of the second engagement part relative to the second adjustment piece.

5. The system of claim 4, wherein the first and second engagement pieces respectively comprise third and fourth interlocking features extending from adjacent ends thereof and configured to engage with each other, thereby preventing the first engagement part from rotating relative to the second engagement part, when the locking mechanism is in the first position.

6. A speaker mounting system comprising:

a speaker housing configured to house or attach to a speaker;

a wall mount configured to be mechanically fastened to a wall;

a first adjustment piece fixed to the wall mount;

a second adjustment piece comprising a hollow portion, wherein the second adjustment piece is slidably and rotatably attached to the first adjustment piece and pivotally attached to the speaker housing, wherein the second adjustment piece is configured to slide and rotate about a center axis of the first adjustment piece and wherein the speaker housing is configured to rotate relative to the second adjustment piece about an axis perpendicular to the center axis of the first adjustment piece; and a locking mechanism having a first position and a second position relative to the second adjustment piece, wherein the locking mechanism is configured for fixing the second adjustment piece relative to the speaker housing in the first position, wherein the speaker housing is pivotable relative to the second adjustment piece about the axis perpendicular to the center axis when the locking mechanism is in the second position, wherein the locking mechanism includes:

a first engagement part fixed to the speaker housing and protruding within the hollow portion of the second adjustment piece, a locking shaft extending through the first engagement part and the hollow portion of the second adjustment piece and comprising screw threads thereon, and a second engagement part positioned within the hollow portion of the second adjustment piece adjacent the first engagement part, the second engagement part having an opening formed therethrough with threads formed therein, wherein the threads within the opening of the second engagement part are engaged with the screw threads on the locking shaft, wherein the second engagement part is configured to engage and disengage with the first engagement part by clockwise and counterclockwise rotation of the shaft.

7. The system of claim 6, wherein the first and second adjustment pieces are biased to lock rotation of the first adjustment piece relative to the second adjustment piece, wherein the second adjustment piece is rotatable relative to the first adjustment piece when the second adjustment piece is pulled or pushed away from or toward the first adjustment piece in an axial direction along the center axis of the first adjustment piece.

8. The system of claim 7, wherein the first adjustment piece comprises a first set of interlocking features and the second adjustment piece comprises a second set of interlocking features configured to interdigitate with the first set of interlocking features when the first and second adjustment pieces are biased to lock rotation and configured to disengage with the first set of interlocking features when the second adjustment piece is pulled or pushed away from or toward the first adjustment piece.

9. The system of claim 8, further comprising a support rod extending within the first adjustment piece and having a first and second end, wherein the first end of the support rod is fixed to the second adjustment piece and the second end of the support rod has a mechanical fastener fixed thereto; and a spring wrapped around the support rod between the mechanical fastener and the first set of interlocking features of the first adjustment piece.

10. The system of claim 6, wherein the second adjustment piece comprises a first set of interlocking features protruding within the hollow portion thereof and the second engagement part comprises a second set of interlocking features protruding outward therefrom and interdigitating with the first set of interlocking features, wherein the first and second set of interlocking features are configured to limit movement of the second engagement part to axial movement relative to the locking shaft and to prevent rotational movement of the second engagement part relative to the second adjustment piece.

11. The system of claim 10, wherein the first and second engagement pieces respectively comprise third and fourth interlocking features extending from adjacent ends thereof and configured to engage with each other, thereby preventing the first engagement part from rotating relative to the second engagement part, when the locking mechanism is in the first position.

12. A speaker mounting system comprising:

a speaker;

a speaker housing configured to house the speaker;

a wall mount configured to be mechanically fastened to a wall;

a hollow first adjustment piece fixed to the wall mount and comprising one or more interlocking features protruding therein;

a second adjustment piece having a solid portion and a hollow portion, the solid portion being slidably and rotatably attached to and positioned within the first adjustment piece and the hollow portion being pivotally attached to the speaker housing, the second adjustment piece comprising one or more interlocking features protruding therefrom, wherein the second adjustment piece is configured to slide and rotate about a center axis of the first adjustment piece and wherein the speaker housing is configured to rotate relative to the second adjustment piece about an axis perpendicular to the center axis of the first adjustment piece;

a biasing member positioned and biased to urge the interlocking features of the first and second adjustment pieces to interdigitate, locking rotation of the first adjustment piece relative to the second adjustment piece, wherein the second adjustment piece is rotatable relative to the first adjustment piece when the second adjustment piece is pulled or pushed away from or toward the first adjustment piece in an axial direction along the center axis of the first adjustment piece to disengage the interlocking features of the first and second adjustment pieces; and a locking mechanism extending within the hollow portion of the second adjustment piece and configured to selectively prevent and allow rotation of the speaker housing relative to the second adjustment piece, wherein the locking mechanism includes:

a first engagement part having a first end fixed to the speaker housing and a second end comprising interlocking features protruding therefrom, wherein the first engagement part extends within the hollow portion of the second adjustment piece, a second engagement part positioned within the hollow portion of the second adjustment piece adjacent the first engagement part, the second engagement part having an opening formed therethrough with threads formed therein and further comprising a first end with interlocking features protruding therefrom, a second end opposite of the first end, and at least one sidewall extending between the first and second ends of the second engagement part and having interlocking features extending therefrom, and a locking shaft extending through the first engagement part, the hollow portion of the second adjustment piece, and the opening formed through the second engagement part, the locking shaft comprising screw threads rotatably engaged with the threads of the second engagement part, wherein the interlocking features of the sidewall of the second engagement part interdigitate with the interlocking features in the hollow portion of the second adjustment piece, limiting movement of the second engagement part to axial movement relative to the locking shaft and preventing rotational movement of the second engagement part relative to the second adjustment piece, wherein the second engagement part is configured to move laterally toward and away from the first engagement part by clockwise and counterclockwise rotation of the locking shaft, wherein the interlocking features protruding from the second end of the first engagement piece are configured to interdigitate with the interlocking features protruding from the first end of the second engagement piece to prevent rotation of the first engagement piece and the speaker housing attached thereto relative to the second engagement piece.

13. The system of claim 12, wherein the locking shaft further comprises fixtures attached to or integral with the locking shaft at or proximate to opposing ends of the locking shaft, wherein the fixtures are configured to limit lateral movement of the shaft relative to the speaker housing.

* * * * *